US009698479B2

(12) United States Patent
Gregoire et al.

(10) Patent No.: US 9,698,479 B2
(45) Date of Patent: Jul. 4, 2017

(54) TWO-DIMENSIONALLY ELECTRONICALLY-STEERABLE ARTIFICIAL IMPEDANCE SURFACE ANTENNA

(71) Applicant: The Boeing Company, Chicago, IL (US)

(72) Inventors: Daniel J. Gregoire, Thousand Oaks, CA (US); Amit M. Patel, Santa Monica, CA (US); Michael de La Chapelle, Bellevue, WA (US)

(73) Assignee: THE BOEING COMPANY, Chicago, IL (US)

( * ) Notice: Subject to any disclaimer, the term of this patent is extended or adjusted under 35 U.S.C. 154(b) by 437 days.

(21) Appl. No.: 14/452,158

(22) Filed: Aug. 5, 2014

(65) Prior Publication Data

US 2015/0009068 A1 Jan. 8, 2015

Related U.S. Application Data

(63) Continuation-in-part of application No. 13/961,967, filed on Aug. 8, 2013, now Pat. No. 9,455,495, which (Continued)

(51) Int. Cl.
*H01Q 3/24* (2006.01)
*H01Q 3/34* (2006.01)

(Continued)

(52) U.S. Cl.
CPC ..... *H01Q 3/34* (2013.01); *H01Q 3/242* (2013.01); *H01Q 3/443* (2013.01); *H01Q 13/28* (2013.01);

(Continued)

(58) Field of Classification Search
CPC ..... H01Q 3/242; H01Q 3/34

(Continued)

(56) References Cited

U.S. PATENT DOCUMENTS 5,724,044 A 3/1998 Tanak
6,496,155 B1 12/2002 Sievenpiper et al.

(Continued)

FOREIGN PATENT DOCUMENTS

DE 19958750 A1 7/2001
EP 2822096 A1 1/2015

OTHER PUBLICATIONS

Office Action, dated Jan. 26, 2014, regarding U.S. Appl. No. 13/961,967, 33 pages.

(Continued)

*Primary Examiner* — Tashiana Adams
*Assistant Examiner* — Helena Seraydaryan
(74) *Attorney, Agent, or Firm* — Yee & Associates, P.C.

(57) ABSTRACT

A method and apparatus for electronically steering an antenna system. The apparatus comprises a dielectric substrate, a plurality of radiating spokes, and a number of surface wave feeds. The plurality of radiating spokes is arranged radially with respect to a center point of the dielectric substrate. Each radiating spoke in the plurality of radiating spokes forms a surface wave channel configured to constrain a path of a surface wave. Each of the number of surface wave feeds couples at least one corresponding radiating spoke in the plurality of radiating spokes to a transmission line that carries a radio frequency signal.

19 Claims, 21 Drawing Sheets

Related U.S. Application Data is a continuation-in-part of application No. 13/934,553, filed on Jul. 3, 2013, now Pat. No. 9,466,887.

(51) Int. Cl.

| | |
|---|---|
| ***H01Q 15/00*** | (2006.01) |
| ***H01Q 3/44*** | (2006.01) |
| ***H01Q 13/28*** | (2006.01) |
| ***H01Q 21/00*** | (2006.01) |

(52) U.S. Cl.
CPC ..... *H01Q 15/0066* (2013.01); *H01Q 21/0006* (2013.01)

(58) Field of Classification Search
USPC ..... 342/372
See application file for complete search history.

(56) References Cited

U.S. PATENT DOCUMENTS

| | | | | |
|---|---|---|---|---|
| 6,677,899 | B1 | 1/2004 | Lee et al. | |
| 7,038,620 | B1 | 5/2006 | Chubb et al. | |
| 7,071,888 | B2 | 7/2006 | Sievenpiper | |
| 7,235,780 | B2 | 6/2007 | de Meijer | |
| 7,245,269 | B2 | 7/2007 | Sievenpiper et al. | |
| 8,436,785 | B1 | 5/2013 | Lai et al. | |
| 2005/0219126 | A1* | 10/2005 | Rebeiz ..... | H01Q 3/242 343/700 MS |
| 2010/0066629 | A1 | 3/2010 | Sievenpiper | |
| 2011/0163930 | A1 | 7/2011 | Lustrac et al. | |
| 2012/0194399 | A1 | 8/2012 | Bily et al. | |
| 2012/0206310 | A1 | 8/2012 | Apostolos et al. | |
| 2014/0266946 | A1 | 9/2014 | Bily et al. | |
| 2015/0214615 | A1 | 7/2015 | Patel et al. | |

OTHER PUBLICATIONS

Notice of Allowance, dated Jun. 2, 2016, regarding U.S. Appl. No. 13/961,967, 9 pages.
Extended European Search Report, dated Aug. 24, 2016, regarding Application No. 16157596.4, 13 pages.
Manasson et al., "Electronically reconfigurable aperture (ERA): A new approach for beam-steering technology", Phases Array Systems and Technology (Array), 2010 IEEE International Symposium on, IEEE, Piscataway, NJ, USA, Oct. 12, 2010, pp. 673-679.
Martinez-Ros et al., "Static and electronic shaping of the radiated electromagnetic fields in radial arrays of substrate integrated leaky-wave antennas" 2013 European Radar Conference, EMA, Oct. 9, 2013, pp. 355-358.
Extended European Search Report, dated Nov. 20, 2014, regarding Application No. EP14172603.4, 12 pages.
Beer et al., "Two-Dimensional Beam Steering based on the Principle of Holographic Antennas," Proceedings of the 2011 International Workshop on Antenna Technology (IWAT), Mar. 2011, pp. 210-213.
Rusch et al., "Electronic Beam Scanning in Two Dimensions with Holographic Phased Array Antenna," 2013 International Workshop on Antenna Technology (iWAn), Mar. 4-6, 2013, pp. 23-26.
Sievenpiper et al., "Holographic Artificial Impedance Surfaces for Conformal Antennas," IEEE Antennas and Propagation Society International Symposium Digest, vol. 1B, Jul. 2005, pp. 256-259.
Fong et al., "Scalar and Tensor Holographic Artificial Impedance Surfaces," IEEE Transactions on Antennas and Propagation, vol. 58, No. 10, Oct. 2010, pp. 3212-3221.
Sievenpiper et al., "A Steerable Leaky-Wave Antenna Using a Tunable Impedance Ground Plate," IEEE Antennas and Wireless Propagation Letters, vol. 1, No. 1, Jan. 2002, pp. 179-182.
Patel et al., "A Printed Leaky-Wave Antenna Based on a Sinusoidally-Modulated Reactance Surface," IEEE Transactions on Antennas and Propagation, vol. 59, No. 6, Jun. 2011, pp. 2087-2096.
Gregoire et al., "Artificial Impedance Surface Antenna Design and Simulation," Proceedings of Antenna Applications Symposium, Sep. 2010, pp. 288-303.
Gregoire et al., "Artificial Impedance Surface Antennas," Proceedings of Antenna Applications Symposium, Sep. 2011, pp. 460-475.
Luukkonen et al., "Simple and Accurate Analytical Model of Planar Grids and High-Impedance Surfaces Comprising Metal Strips or Patches," IEEE Transactions on Antennas and Propagation, vol. 56, No. 6, Jun. 2008, pp. 1624-1632.
Colburn et al., "Adaptive Artificial Impedance Surface Conformal Antennas," Antennas and Propagation Society International Symposium, Jun. 2009, 4 pages.
Gregoire et al., "Surface-Wave Waveguides," IEEE Antennas and Wireless Propagation Letters, vol. 10, Aug. 2011, pp. 1512-1515.
Gregoire, "Conformal Surface Wave Feed," U.S. Appl. No. 13/242,102, filed Sep. 23, 2011, 17 pages.
Gregoire, "Low Cost, 2D, Electronically-Steerable, Artificial-Impedance Surface Antenna," U.S. Appl. No. 13/934,553, filed Jul. 3, 2013, 36 pages.
Gregoire, "Two-Dimensionally Electronically-Steerable Artificial Impedance Surface Antenna," U.S. Appl. No. 13/961,967, filed Aug. 8, 2013, 66 pages.

* cited by examiner

TWO-DIMENSIONALLY ELECTRONICALLY-STEERABLE ARTIFICIAL IMPEDANCE SURFACE ANTENNA

CROSS REFERENCE TO PARENT APPLICATIONS

This application is a continuation-in-part (CIP) of and claims priority to the following U.S. patent application entitled "Two-Dimensionally Electronically-Steerable Artificial Impedance Surface Antenna," Ser. No. 13/961,967, filed Aug. 8, 2013, which is a continuation-in-part (CIP) application that claims priority to the following U.S. patent application entitled "Low-Cost, 2D, Electronically-Steerable, Artificial-Impedance-Surface Antenna," Ser. No. 13/934,553, filed Jul. 3, 2013, both of which are incorporated herein by reference.

CROSS REFERENCE TO RELATED APPLICATIONS

Further, this application is related to the disclosure of U.S. patent application entitled "Electrically Tunable Surface Impedance Structure with Suppressed Backward Wave," Ser. No. 12/939,040, filed Nov. 3, 2010, and the disclosure of U.S. patent application entitled "Conformal Surface Wave Feed," Ser. No. 13/242,102, filed Sep. 23, 2011, the disclosures of which are incorporated herein by reference.

FIELD

The present disclosure relates generally to antennas and, in particular, to electronically-steerable antennas. Still more particularly, the present disclosure relates to an electronically-steerable artificial impedance antenna capable of being steered in two dimensions.

BACKGROUND

In various applications, having the capability to electronically steer an antenna in two directions may be desirable. As used herein, "steering" an antenna may include directing the primary gain lobe, or main lobe, of the radiation pattern of the antenna in a particular direction. Electronically steering an antenna means steering the antenna using electronic, rather than mechanical, means. Steering an antenna with respect to two dimensions may be referred to as two-dimensional steering.

Currently, two-dimensional steering is typically provided by phased array antennas. However, currently available phased array antennas have electronic configurations that are more complex and/or more costly than desired. Consequently, having some other type of antenna that can be electronically steered in two dimensions and that is low-cost relative to a phased array antenna may be desirable.

Artificial impedance surface antennas (AISAs) may be less expensive than phased array antennas. An artificial impedance surface antenna may be implemented by launching a surface wave across an artificial impedance surface (AIS) having an impedance that is spatially modulated across the artificial impedance surface according to a function that matches the phase fronts between the surface wave on the artificial impedance surface and the desired far-field radiation pattern. The basic principle of an artificial impedance surface antenna operation is to use the grid momentum of the modulated artificial impedance surface to match the wave vectors of an excited surface wave front to a desired plane wave.

Some low-cost artificial impedance surface antennas may only be capable of being electronically steered in one dimension. In some cases, mechanical steering may be used to steer a one-dimensional artificial impedance surface antenna in a second dimension. However, mechanical steering may be undesirable in certain applications.

A two-dimensional electronically-steerable artificial impedance surface antenna has been described in prior art. However, this type of antenna is more expensive and electronically complex than desired. For example, electronically steering this type of antenna in two dimensions may require a complex network of voltage control for a two-dimensional array of impedance elements. This network is used to create an arbitrary impedance pattern that can produce beam steering in any direction.

In one illustrative example, a two-dimensional artificial impedance surface antenna may be implemented as a grid of metallic patches on a dielectric substrate. Each metallic path may be referred to as an impedance element. The surface wave impedance of the artificial impedance surface may be locally controlled at each position on the artificial impedance surface by applying a variable voltage to voltage-variable varactors connected between each of the patches. A varactor is a semiconductor element diode that has a capacitance dependent on the voltage applied to this diode.

The surface wave impedance of the artificial impedance surface can be tuned with capacitive loads inserted between the patches. Each patch is electrically connected to neighboring patches on all four sides with voltage-variable varactor capacitors. The voltage is applied to the varactors through electrical vias connected to each patch. An electrical via may be an electrical connection that goes through the plane of one or more adjacent layers in an electronic circuit.

One portion of the patches may be electrically connected to the ground plane with vias that run from the center of each patch down through the dielectric substrate. The rest of the patches may be electrically connected to voltage sources that run through the dielectric substrate, and through holes in the ground plane to the voltage sources.

Computer control allows any desired impedance pattern to be applied to the artificial impedance surface within the limits of the varactor tunability and the limitations of the surface wave properties of the artificial impedance surface. One of the limitations of this method is that the vias can severely reduce the operational bandwidth of the artificial impedance surface because the vias also impart an inductance to the artificial impedance surface that shifts the surface wave bandgap to a lower frequency. As the varactors are tuned to higher capacitance, the artificial impedance surface inductance is increased, which may further reduce the surface wave bandgap frequency. The net result of the surface wave bandgap is that it does not allow the artificial impedance surface to be used above the bandgap frequency. Further, the surface wave bandgap also limits the range of surface wave impedance to that which the artificial impedance surface can be tuned.

Consequently, an artificial impedance surface antenna that can be electronically steered in two dimensions and that is less expensive and less complex than some currently available two-dimensional artificial impedance surface antennas, such as the one described above, may be desirable in certain applications. Therefore, it would be desirable to have a method and apparatus that take into account at least some of the issues discussed above, as well as other possible issues.

SUMMARY

In one illustrative embodiment, an apparatus comprises a dielectric substrate, a plurality of radiating spokes, and a number of surface wave feeds. The plurality of radiating spokes is arranged radially with respect to a center point of the dielectric substrate. Each radiating spoke in the plurality of radiating spokes forms a surface wave channel configured to constrain a path of a surface wave. Each of the number of surface wave feeds couples at least one corresponding radiating spoke in the plurality of radiating spokes to a transmission line that carries a radio frequency signal.

In another illustrative embodiment, an antenna system comprises a dielectric substrate, a plurality of radiating spokes, a voltage controller, and a number of surface wave feeds. The plurality of radiating spokes is arranged radially with respect to a center point of the dielectric substrate. Each of the plurality of radiating spokes forms a surface wave channel configured to constrain a path of a surface wave. Each of the plurality of radiating spokes comprises a plurality of impedance elements and a plurality of tunable elements located on a surface of the dielectric substrate. The plurality of tunable elements is electrically connected to the plurality of impedance elements. The voltage controller controls voltages applied to the plurality of tunable elements of each radiating spoke to control a theta steering angle of a main lobe of a radiation sub-pattern generated by each radiating spoke. Each of the number of surface wave feeds couples at least one corresponding radiating spoke in the plurality of radiating spokes to a transmission line that carries a radio frequency signal.

In yet another illustrative embodiment, a method for electronically steering a radiation pattern of an antenna is provided. Surface waves are propagated along a plurality of surface wave channels formed by a plurality of radiating spokes to generate a number of radiation patterns. The plurality of radiating spokes is arranged radially with respect to a center point of a dielectric substrate and coupled to a number of surface wave feeds. A main lobe of the radiation pattern of the antenna is electronically steered in two dimensions.

The features and functions can be achieved independently in various embodiments of the present disclosure or may be combined in yet other embodiments in which further details can be seen with reference to the following description and drawings.

BRIEF DESCRIPTION OF THE DRAWINGS

The novel features believed characteristic of the illustrative embodiments are set forth in the appended claims. The illustrative embodiments, however, as well as a preferred mode of use, further objectives and features thereof, will best be understood by reference to the following detailed description of an illustrative embodiment of the present disclosure when read in conjunction with the accompanying drawings, wherein:

DETAILED DESCRIPTION

Figure 1:
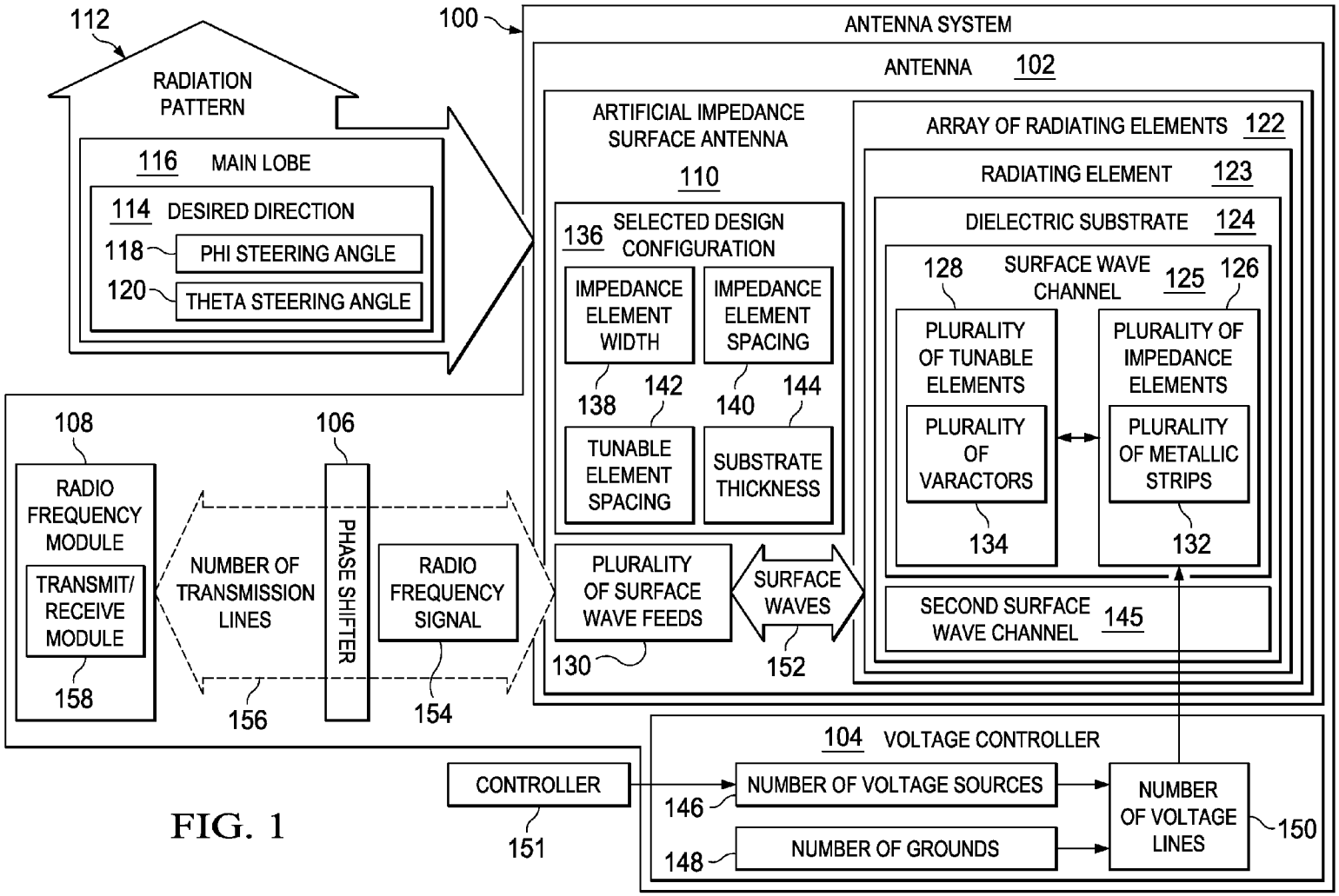
FIG. 1 is an illustration of an antenna system in the form of a block diagram in accordance with an illustrative embodiment.

Referring now to the figures and, in particular, with reference to FIG. 1, an illustration of an antenna system in the form of a block diagram is depicted in accordance with an illustrative embodiment. Antenna system 100 may include antenna 102, voltage controller 104, phase shifter 106, and radio frequency module 108. Antenna 102 takes the form of artificial impedance surface antenna (AISA) 110 in this illustrative example.

Antenna 102 is configured to transmit and/or receive radiation pattern 112. Radiation pattern 112 is a plot of the gain of antenna 102 as a function of direction. The gain of antenna 102 may be considered a performance parameter for antenna 102. In some cases, "gain" is considered the peak value of gain.

Antenna 102 is configured to electronically control radiation pattern 112. When antenna 102 is used for transmitting, radiation pattern 112 may be the strength of the radio waves transmitted from antenna 102 as a function of direction. Radiation pattern 112 may be referred to as a transmitting pattern when antenna 102 is used for transmitting. The gain of antenna 102, when transmitting, may describe how well antenna 102 converts electrical power into electromagnetic radiation, such as radio waves, and transmits the electromagnetic radiation in a specified direction.

When antenna 102 is used for receiving, radiation pattern 112 may be the sensitivity of antenna 102 to radio waves as a function of direction. Radiation pattern 112 may be referred to as a receiving pattern when antenna 102 is used for receiving. The gain of antenna 102, when used for receiving, may describe how well antenna 102 converts electromagnetic radiation, such as radio waves, arriving from a specified direction into electrical power.

The transmitting pattern and receiving pattern of antenna 102 may be identical. Consequently, the transmitting pattern and receiving pattern of antenna 102 may be simply referred to as radiation pattern 112.

Radiation pattern 112 may include main lobe 116 and one or more side lobes. Main lobe 116 may be the lobe at the direction in which antenna 102 is being directed. When antenna 102 is used for transmitting, main lobe 116 is located at the direction in which antenna 102 transmits the strongest radio waves to form a radio frequency beam. When antenna 102 is used for transmitting, main lobe 116 may also be referred to as the primary gain lobe of radiation pattern 112. When antenna 102 is used for receiving, main lobe 116 is located at the direction in which antenna 102 is most sensitive to incoming radio waves.

In this illustrative example, antenna 102 is configured to electronically steer main lobe 116 of radiation pattern 112 in desired direction 114. Main lobe 116 of radiation pattern 112 may be electronically steered by controlling phi steering angle 118 and theta steering angle 120 at which main lobe 116 is directed. Phi steering angle 118 and theta steering angle 120 are spherical coordinates. When antenna 102 is operating in an X-Y plane, phi steering angle 118 is the angle of main lobe 116 in the X-Y plane relative to the X-axis. Further, theta steering angle 120 is the angle of main lobe 116 relative to a Z-axis that is orthogonal to the X-Y plane.

Antenna 102 may operate in the X-Y plane by having array of radiating elements 122 that lie in the X-Y plane. As used herein, an "array" of items may include one or more items arranged in rows and/or columns. In this illustrative example, array of radiating elements 122 may be a single radiating element or a plurality of radiating elements. In one illustrative example, each radiating element in array of radiating elements 122 may take the form of an artificial impedance surface, surface wave waveguide structure.

Radiating element 123 may be an example of one radiating element in array of radiating elements 122. Radiating element 123 may be configured to emit radiation that contributes to radiation pattern 112.

As depicted, radiating element 123 is implemented using dielectric substrate 124. Dielectric substrate 124 may be implemented as a layer of dielectric material. A dielectric material is an electrical insulator that can be polarized by an applied electric field.

Radiating element 123 may include one or more surface wave channels that are formed on dielectric substrate 124. For example, radiating element 123 may include surface wave channel 125. Surface wave channel 125 is configured to constrain the path of surface waves propagated along dielectric substrate 124, and surface wave channel 125 in particular.

In one illustrative example, array of radiating elements 122 may be positioned substantially parallel to the X-axis and arranged and spaced along the Y-axis. Further, when more than one surface wave channel is formed on a dielectric substrate, these surface wave channels may be formed substantially parallel to the X-axis and arranged and spaced along the Y-axis.

In this illustrative example, impedance elements and tunable elements located on a dielectric substrate may be used to form each surface wave channel of a radiating element in array of radiating elements 122. For example, surface wave channel 125 may be comprised of plurality of impedance elements 126 and plurality of tunable elements 128 located on the surface of dielectric substrate 124. Together, plurality of impedance elements 126, plurality of tunable elements 128, and dielectric substrate 124 form an artificial impedance surface from which radiation is generated.

An impedance element in plurality of impedance elements 126 may be implemented in a number of different ways. In one illustrative example, an impedance element may be implemented as a resonating element. In one illustrative example, an impedance element may be implemented as an element comprised of a conductive material. The conductive material may be, for example, without limitation, a metallic material. Depending on the implementation, an impedance element may be implemented as a metallic strip, a patch of conductive paint, a metallic mesh material, a metallic film, a deposit of a metallic substrate, or some other type of conductive element. In some cases, an impedance element may be implemented as a resonant structure such as, for example, a split-ring resonator (SRR), an electrically-coupled resonator (ECR), a structure comprised of one or more metamaterials, or some other type of structure or element.

As used herein, a metamaterial may be an artificial material engineered to have properties that may not be found in nature. A metamaterial may be an assembly of multiple individual elements formed from conventional microscopic materials. These conventional materials may include, for example, without limitation, metal, a metal alloy, a plastic material, and other types of materials. However, these conventional materials may be arranged in repeating patterns. The properties of a metamaterial may be based, not on the composition of the metamaterial, but on the exactingly-designed structure of the metamaterial. In particular, the precise shape, geometry, size, orientation, arrangement, or combination thereof may be exactly designed to produce a metamaterial with specific properties that may not be found or readily found in nature.

Each one of plurality of tunable elements 128 may be an element that can be controlled, or tuned, to change an angle of the one or more surface waves being propagated along radiating element 123. In this illustrative example, each of plurality of tunable elements 128 may be an element having a capacitance that can be varied based on the voltage applied to the tunable element.

In one illustrative example, plurality of impedance elements 126 takes the form of plurality of metallic strips 132 and plurality of tunable elements 128 takes the form of plurality of varactors 134. Each of plurality of varactors 134 may be a semiconductor element diode that has a capacitance dependent on the voltage applied to the semiconductor element diode.

In one illustrative example, plurality of metallic strips 132 may be arranged in a row that extends along the X-axis. For example, plurality of metallic strips 132 may be periodically distributed on dielectric substrate 124 along the X-axis. Plurality of varactors 134 may be electrically connected to plurality of metallic strips 132 on the surface of dielectric substrate 124. In particular, at least one varactor in plurality of varactors 134 may be positioned between each adjacent pair of metallic strips in plurality of metallic strips 132. Further, plurality of varactors 134 may be aligned such that all of the varactor connections on each metallic strip have the same polarity.

Dielectric substrate 124, plurality of impedance elements 126, and plurality of tunable elements 128 may be configured with respect to selected design configuration 136 for surface wave channel 125, and radiating element 123 in particular. Depending on the implementation, each radiating element in array of radiating elements 122 may have a same or different selected design configuration.

As depicted, selected design configuration 136 may include a number of design parameters such as, but not limited to, impedance element width 138, impedance element spacing 140, tunable element spacing 142, and substrate thickness 144. Impedance element width 138 may be the width of an impedance element in plurality of impedance elements 126. Impedance element width 138 may be selected to be the same or different for each of plurality of impedance elements 126, depending on the implementation.

Impedance element spacing 140 may be the spacing of plurality of impedance elements 126 with respect to the X-axis. Tunable element spacing 142 may be the spacing of plurality of tunable elements 128 with respect to the X-axis. Further, substrate thickness 144 may be the thickness of dielectric substrate 124 on which a particular waveguide is implemented.

The values for the different parameters in selected design configuration 136 may be selected based on, for example, without limitation, the radiation frequency at which antenna 102 is configured to operate. Other considerations include, for example, the desired impedance modulations for antenna 102.

Voltages may be applied to plurality of tunable elements 128 by applying voltages to plurality of impedance elements 126 because plurality of impedance elements 126 may be electrically connected to plurality of tunable elements 128. In particular, the voltages applied to plurality of impedance elements 126, and thereby plurality of tunable elements 128, may change the capacitance of plurality of tunable elements 128. Changing the capacitance of plurality of tunable elements 128 may, in turn, change the surface impedance of antenna 102. Changing the surface impedance of antenna 102 changes radiation pattern 112 produced.

In other words, by controlling the voltages applied to plurality of impedance elements 126, the capacitances of plurality of tunable elements 128 may be varied. Varying the capacitances of plurality of tunable elements 128 may vary, or modulate, the capacitive coupling and impedance between plurality of impedance elements 126. Varying, or modulating, the capacitive coupling and impedance between plurality of impedance elements 126 may change theta steering angle 120.

The voltages may be applied to plurality of impedance elements 126 using voltage controller 104. Voltage controller 104 may include number of voltage sources 146, number of grounds 148, number of voltage lines 150, and/or some other type of component. In some cases, voltage controller 104 may be referred to as a voltage control network. As used herein, a "number of" items may include one or more items. For example, number of voltage sources 146 may include one or more voltage sources; number of grounds 148 may include one or more grounds; and number of voltage lines 150 may include one or more voltage lines.

A voltage source in number of voltage sources 146 may take the form of, for example, without limitation, a digital to analog converter (DAC), a variable voltage source, or some other type of voltage source. Number of grounds 148 may be used to ground at least a portion of plurality of impedance elements 126. Number of voltage lines 150 may be used to transmit voltage from number of voltage sources 146 and/or number of grounds 148 to plurality of impedance elements 126. In some cases, each of number of voltage lines 150 may be referred to as a via. In one illustrative example, number of voltage lines 150 may take the form of a number of metallic vias.

In one illustrative example, each of plurality of impedance elements 126 may receive voltage from one of number of voltage sources 146. In another illustrative example, a portion of plurality of impedance elements 126 may receive voltage from number of voltage sources 146 through a corresponding portion of number of voltage lines 150, while another portion of plurality of impedance elements 126 may be electrically connected to number of grounds 148 through a corresponding portion of number of voltage lines 150.

In some cases, controller 151 may be used to control number of voltage sources 146. Controller 151 may be considered part of or separate from antenna system 100, depending on the implementation. Controller 151 may be implemented using a microprocessor, an integrated circuit, a computer, a central processing unit, a plurality of computers in communication with each other, or some other type of computer or processor.

Surface waves 152 propagated along array of radiating elements 122 may be coupled to number of transmission lines 156 by plurality of surface wave feeds 130 located on dielectric substrate 124. A surface wave feed in plurality of surface wave feeds 130 may be any device that is capable of converting a surface wave into a radio frequency signal and/or a radio frequency signal into a surface wave. In one illustrative example, a surface wave feed in plurality of surface wave feeds 130 is located at the end of each waveguide in array of radiating elements 122 on dielectric substrate 124.

For example, when antenna 102 is in a receiving mode, the one or more surface waves propagating along radiating element 123 may be received at a corresponding surface wave feed in plurality of surface wave feeds 130 and converted into a corresponding radio frequency signal 154. Radio frequency signal 154 may be sent to radio frequency module 108 over one or more of number of transmission lines 156. Radio frequency module 108 may then function as a receiver and process radio frequency signal 154 accordingly.

Depending on the implementation, radio frequency module 108 may function as a transmitter, a receiver, or a combination of the two. In some illustrative examples, radio frequency module 108 may be referred to as transmit/receive module 158. In some cases, when configured for transmitting, radio frequency module 108 may be referred to as a radio frequency source.

In some cases, radio frequency signal 154 may pass through phase shifter 106 prior to being sent to radio frequency module 108. Phase shifter 106 may include any number of phase shifters, power dividers, transmission lines, and/or other components configured to shift the phase of radio frequency signal 154. In some cases, phase shifter 106 may be referred to as a phase-shifting network.

When antenna 102 is in a transmitting mode, radio frequency signal 154 may be sent from radio frequency module 108 to antenna 102 over number of transmission lines 156. In particular, radio frequency signal 154 may be received at one of plurality of surface wave feeds 130 and converted into one or more surface waves that are then propagated along a corresponding waveguide in array of radiating elements 122.

In this illustrative example, the relative phase difference between plurality of surface wave feeds 130 may be changed to change phi steering angle 118 of radiation pattern 112 that is transmitted or received. Thus, by controlling the relative phase difference between plurality of surface wave feeds 130 and controlling the voltages applied to the tunable elements of each waveguide in array of radiating elements 122, phi steering angle 118 and theta steering angle 120, respectively, may be controlled. In other words, antenna 102 may be electronically steered in two dimensions.

Depending on the implementation, radiating element 123 may be configured to emit linearly polarized radiation or circularly polarized radiation. When configured to emit linearly polarized radiation, the plurality of metallic strips used for each surface wave channel on radiating element 123 may be angled in the same direction relative to the X-axis along which the plurality of metallic strips are distributed. Typically, only a single surface wave channel is needed for each radiating element 123.

However, when radiating element 123 is configured for producing circularly polarized radiation, surface wave channel 125 may be a first surface wave channel and second surface wave channel 145 may be also present in radiating element 123. Surface wave channel 125 and second surface wave channel 145 may be about 90 degrees out of phase from each other. The interaction between the radiation from these two coupled surface wave channels makes it possible to create circularly polarized radiation.

Plurality of impedance elements 126 that form surface wave channel 125 may be a first plurality of impedance elements that radiate with a polarization at an angle to the polarization of the surface wave electric field. A second plurality of impedance elements that form second surface wave channel 145 may radiate with a polarization at an angle offset about 90 degrees as compared to surface wave channel 125.

For example, each impedance element in the first plurality of impedance elements of surface wave channel 125 may have a tensor impedance with a principal angle that is angled at a first angle relative to an X-axis of radiating element 123. Further, each impedance element in the second plurality of impedance elements of second surface wave channel 145 may have a tensor impedance that is angled at a second angle relative to the X-axis of the corresponding radiating element. The difference between the first angle and the second angle may be about 90 degrees.

The capacitance between the first plurality of impedance elements may be controlled using plurality of tunable elements 128, which may be a first plurality of tunable elements. The capacitance between the second plurality of impedance elements may be controlled using a second plurality of tunable elements.

As a more specific example, plurality of metallic strips 132 on surface wave channel 125 may be angled at about positive 45 degrees with respect to the X-axis along which plurality of metallic strips 132 is distributed. However, the plurality of metallic strips used for second surface wave channel 145 may be angled at about negative 45 degrees with respect to the X-axis along which the plurality of metallic strips is distributed. This variation in tilt angle produces radiation of different linear polarizations, that when combined with a 90 degree phase shift, may produce circularly polarized radiation.

The illustration of antenna system 100 in FIG. 1 is not meant to imply physical or architectural limitations to the manner in which an illustrative embodiment may be implemented. Other components in addition to or in place of the ones illustrated may be used. Some components may be optional. Also, the blocks are presented to illustrate some functional components. One or more of these blocks may be combined, divided, or combined and divided into different blocks when implemented in an illustrative embodiment.

For example, in other illustrative examples, phase shifter 106 may not be included in antenna system 100. Instead, number of transmission lines 156 may be used to couple plurality of surface wave feeds 130 to a number of power dividers and/or other types of components, and these different components to radio frequency module 108. In some examples, number of transmission lines 156 may directly couple plurality of surface wave feeds 130 to radio frequency module 108.

In some illustrative examples, a tunable element in plurality of tunable elements 128 may be implemented as a pocket of variable material embedded in dielectric substrate 124. As used herein, a "variable material" may be any material having a permittivity that may be varied. The permittivity of the variable material may be varied to change, for example, the capacitance between two impedance elements between which the variable material is located. The variable material may be a voltage-variable material or any electrically variable material, such as, for example, without limitation, a liquid crystal material or barium strontium titanate (BST).

In other illustrative examples, a tunable element in plurality of tunable elements 128 may be part of a corresponding impedance element in plurality of impedance elements 126. For example, a resonant structure having a tunable element may be used. The resonant structure may be, for example, without limitation, a split-ring resonator, an electrically-coupled resonator, or some other type of resonant structure.

Figure 2:
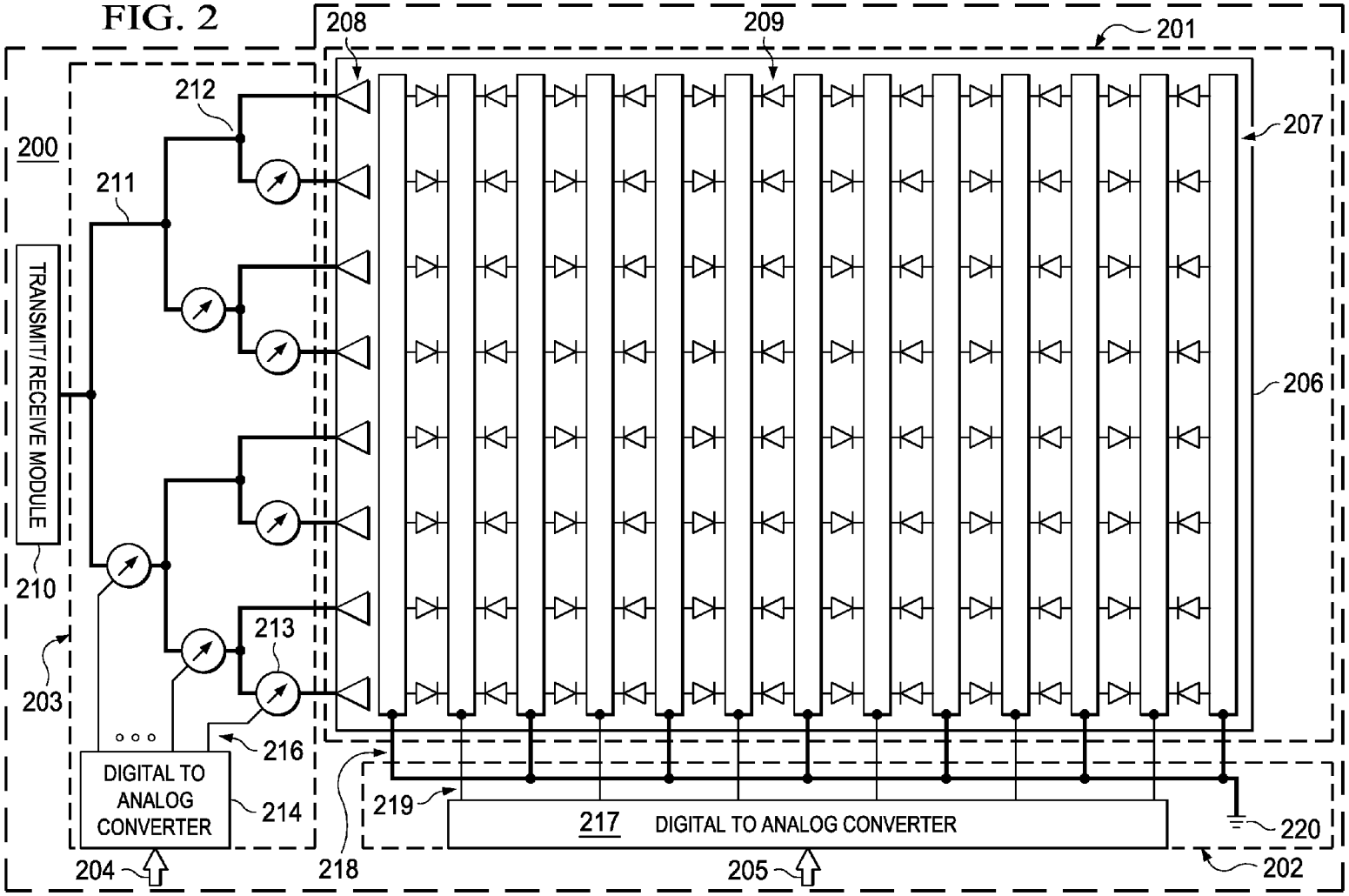
FIG. 2 is an illustration of an antenna system in accordance with an illustrative embodiment.

With reference now to FIG. 2, an illustration of an antenna system is depicted in accordance with an illustrative embodiment. Antenna system 200 may be an example of one implementation for antenna system 100 in FIG. 1. As depicted, antenna system 200 includes tunable artificial impedance surface antenna (AISA) 201, which may be an example of one implementation for artificial impedance surface antenna 110 in FIG. 1. Further, antenna system 200 may also include voltage controller 202 and phase shifter 203. Voltage controller 202 and phase shifter 203 may be examples of implementations for voltage controller 104 and phase shifter 106, respectively, in FIG. 1.

In this illustrative example, tunable artificial impedance surface antenna 201 is a relatively low cost antenna capable of being electronically steered in both theta, $\theta$, and phi, $\phi$ directions. When tunable artificial impedance surface antenna 201 is operating in the X-Y plane, the theta direction may be a direction perpendicular to the Z axis that is perpendicular to the X-Y plane, while the phi direction may be a direction parallel to the X-Y plane.

As depicted, tunable artificial impedance surface antenna 201 includes dielectric substrate 206, metallic strips 207, varactors 209, and radio frequency (RF) surface wave feeds 208. Metallic strips 207 may be a periodic array of metallic strips 207 that are located on one surface of dielectric substrate 206. Varactors 209 may be located between metallic strips 207. Dielectric substrate 206 may or may not have a ground plane (not shown in this view) on a surface of dielectric substrate 206 opposite to the surface on which metallic strips 207 are located.

Steering of the main lobe of tunable artificial impedance surface antenna 201 in the theta direction is controlled by varying, or modulating, the surface wave impedance of tunable artificial impedance surface antenna 201. For example, the impedance of tunable artificial impedance surface antenna 201 may be varied, or modulated, by controlling the voltages applied to metallic strips 207 located on the surface of dielectric substrate 206. With varactors 209 present between metallic strips 207, the voltage applied to varactors 209 may be controlled using metallic strips 207. Each of varactors 209 is a type of diode that has a capacitance that varies as a function of the voltage applied across the terminals of the diode.

The voltages applied to metallic strips 207 may change the capacitance of varactors 209 between metallic strips 207, which may, in turn, change the impedance of tunable artificial impedance surface antenna 201. In other words, by controlling the voltages applied to metallic strips 207, the capacitances of varactors 209 may be varied. Varying the capacitances of varactors 209 may vary or modulate the capacitive coupling and impedance between metallic strips 207 to steer the beam produced by antenna system 200 in the theta direction.

In this illustrative example, radio frequency surface wave feeds 208 may be a two-dimensional array of radio frequency surface wave feeds. Steering of the main lobe of tunable artificial impedance surface antenna 201 in the phi direction is controlled by changing the relative phase difference between radio frequency surface wave feeds 208.

Voltage controller 202 is used to apply direct current (DC) voltages to metallic strips 207 on the structure of tunable artificial impedance surface antenna 201. Voltage controller 202 may be controlled based on commands received through control bus 205. In this manner, control bus 205 provides control for voltage controller 202. Further, control bus 204 may provide control for phase shifter 203. Each of control bus 204 and control bus 205 may be a bus from a microprocessor, a central processing unit (CPU), one or more computers, or some other type of computer or processor.

In this illustrative example, the polarities of varactors 209 may be aligned such that all varactor connections to any one of metallic strips 207 may be connected with the same polarity. One terminal on a varactor may be referred to as an anode, and the other terminal may be referred to as a cathode. Thus, some of metallic strips 207 are only connected to anodes of varactors 209, while other of metallic strips 207 are only connected to cathodes of varactors 209. Further, as depicted, adjacent metallic strips 207 may alternate with respect to which ones are connected to the anodes of varactors 209 and which ones are connected to the cathodes of varactors 209.

The spacing of metallic strips 207 in one dimension of tunable artificial impedance surface antenna 201, which may be in an X direction, may be a fraction of the radio frequency surface wave wavelength of the radio frequency waves that propagate across tunable artificial impedance surface antenna 201 from radio frequency surface wave feeds 208. In one illustrative example, the spacing of metallic strips 207 may be at most ⅖ of the radio frequency surface wave wavelength of the radio frequency waves. In another illustrative example, the fraction may be only about 2/10 of the radio frequency surface wave wavelength of the radio frequency waves. Depending on the implementation, the spacing between varactors 209 connected to metallic strips 207 in a second dimension of tunable artificial impedance surface antenna 201, which may be in a Y direction, may be about the same as the spacing between metallic strips 207.

Radio frequency surface wave feeds 208 may form a phased array corporate feed structure, or may take the form of conformal surface wave feeds, which are integrated into tunable artificial impedance surface antenna 201. The surface wave feeds may be integrated into tunable artificial impedance surface antenna 201, for example, using microstrips. The spacing between radio frequency surface wave feeds 208 in the Y direction may be based on selected rules that indicate that the spacing be no farther apart than the free-space wavelength for the highest frequency signal to be transmitted or received.

In this illustrative example, the thickness of dielectric substrate 206 may be determined by the permittivity of dielectric substrate 206 and the frequency of radiation to be transmitted or received. The higher the permittivity, the thinner dielectric substrate 206 may be.

The capacitance values of varactors 209 may be determined by the range needed for the desired impedance modulations for tunable artificial impedance surface antenna 201 in order to obtain the various angles of radiation. Further, the particular substrate used for dielectric substrate 206 may be selected based on the operating frequency, or radio frequency, of tunable artificial impedance surface antenna 201.

For example, when tunable artificial impedance surface antenna 201 is operating at about 20 gigahertz, dielectric substrate 206 may be implemented using, without limitation, a substrate, available from Rogers Corporation, having a thickness of about 50 millimeters (mm). In this example, dielectric substrate 206 may have a relative permittivity equal to about 12.2. Metallic strips 207 may be spaced about two millimeters to about three millimeters apart on dielectric substrate 206. Further, radio frequency surface wave feeds 208 may be spaced about 2.5 centimeters apart and varactors 209 may be spaced about two millimeters to about three millimeters apart in this example. Varactors 209 may vary in capacitance from about 0.2 picofarads (pF) to about 2.0 picofarads. Of course, other specifications may be used for tunable artificial impedance surface antenna 201 for different radiation frequencies.

To transmit or receive a radio frequency signal using tunable artificial impedance surface antenna 201, transmit/receive module 210 is connected to phase shifter 203. Phase shifter 203 may be a one-dimensional phase shifter in this illustrative example. Phase shifter 203 may be implemented using any type of currently available phase shifter, including those used in phased array antennas.

In this illustrative example, phase shifter 203 includes radio frequency transmission lines 211 connected to transmit/receive module 210, power dividers 212, and phase shifters 213. Phase shifters 213 are controlled by voltage control lines 216 connected to digital to analog converter (DAC) 214. Digital to analog converter 214 receives digital control signals from control bus 204 to control the steering in the phi direction.

The main lobe of tunable artificial impedance surface antenna 201 may be steered in the phi direction by using phase shifter 203 to impose a phase shift between each of radio frequency surface wave feeds 208. If radio frequency surface wave feeds 208 are spaced uniformly, then the phase shift between adjacent radio frequency surface wave feeds 208 may be substantially constant. The relationship between the phi (ϕ) steering angle and the phase shift may be calculated using standard phased array methods, according to the following equation:

$$\phi=\sin^{-1}(\lambda\Delta\psi/2\pi d) \quad (1)$$

where λ is the radiation wavelength, d is the spacing between radio frequency surface wave feeds 208, and Δψ is the phase shift between these surface wave feeds. In some cases, these surface wave feeds may also be spaced non-uniformly, and the phase shifts adjusted accordingly.

As described earlier, the main lobe of tunable artificial impedance surface antenna 201 may be steered in the theta (θ) direction by applying voltages to varactors 209 such that tunable artificial impedance surface antenna 201 has surface wave impedance $Z_{sw}$, which is modulated or varied periodically with the distance (x) away from radio frequency surface wave feeds 208, according to the following equation:

$$Z_{sw}=X+M\cos(2\pi x/p) \quad (2)$$

where X and M are the mean impedance and the amplitude, respectively, of the modulation of tunable artificial impedance surface antenna 201, and p is the modulation period. The variation of the surface wave impedance, $Z_{sw}$, may be modulated sinusoidally. The theta steering angle, θ, is related to the impedance modulation by the following equation:

$$\theta=\sin^{-1}(n_{sw}-\lambda/p) \quad (3)$$

where λ is the wavelength of the radiation, and $$n_{sw}=\sqrt{(X/377\Omega)^2+1} \quad (4)$$

is the mean surface wave index.

The beam is steered in the theta direction by tuning the voltages applied to varactors 209 such that X, M, and p result in the desired theta steering angle, θ. The dependence of the surface wave impedance on the varactor capacitance is calculated using transcendental equations resulting from the transverse resonance method or by using full-wave numerical simulations.

Voltages may be applied to varactors 209 by grounding alternate metallic strips 207 to ground 220 via voltage control lines 218 and applying tunable voltages via voltage control lines 219 to the rest of metallic strips 207. The voltage applied to each of voltage control lines 219 may be a function of the desired theta steering angle and may be different for each of voltage control lines 219. The voltages may be applied from digital-to-analog converter (DAC) 217 that receives digital controls from control bus 205 from a controller for steering in the theta direction. The controller may be a microprocessor, central processing unit (CPU) or any computer, processor or controller.

One benefit of grounding half of metallic strips 207 is that only half as many voltage control lines 219 are required as there are metallic strips 207. However, in some cases, the spatial resolution of the voltage control and hence, the impedance modulation, may be limited to twice the spacing between metallic strips 207.

Figure 3:
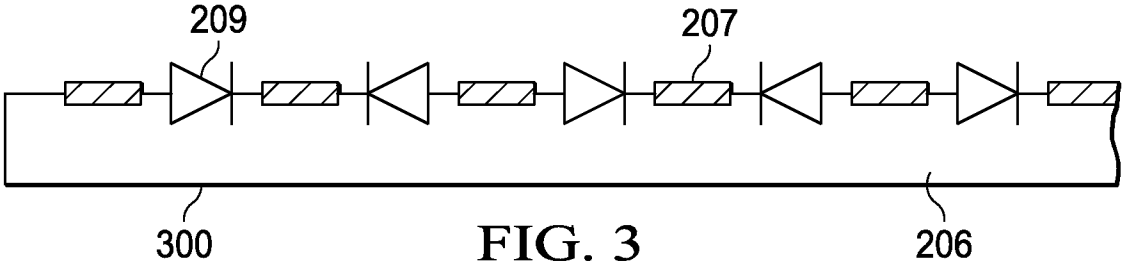
FIG. 3 is an illustration of a side view of a portion of a tunable artificial impedance surface antenna in accordance with an illustrative embodiment.

With reference now to FIG. 3, an illustration of a side view of a portion of tunable artificial impedance surface antenna 201 from FIG. 2 is depicted in accordance with an illustrative embodiment. In this illustrative example, dielectric substrate 206 has ground plane 300.

Figure 4:
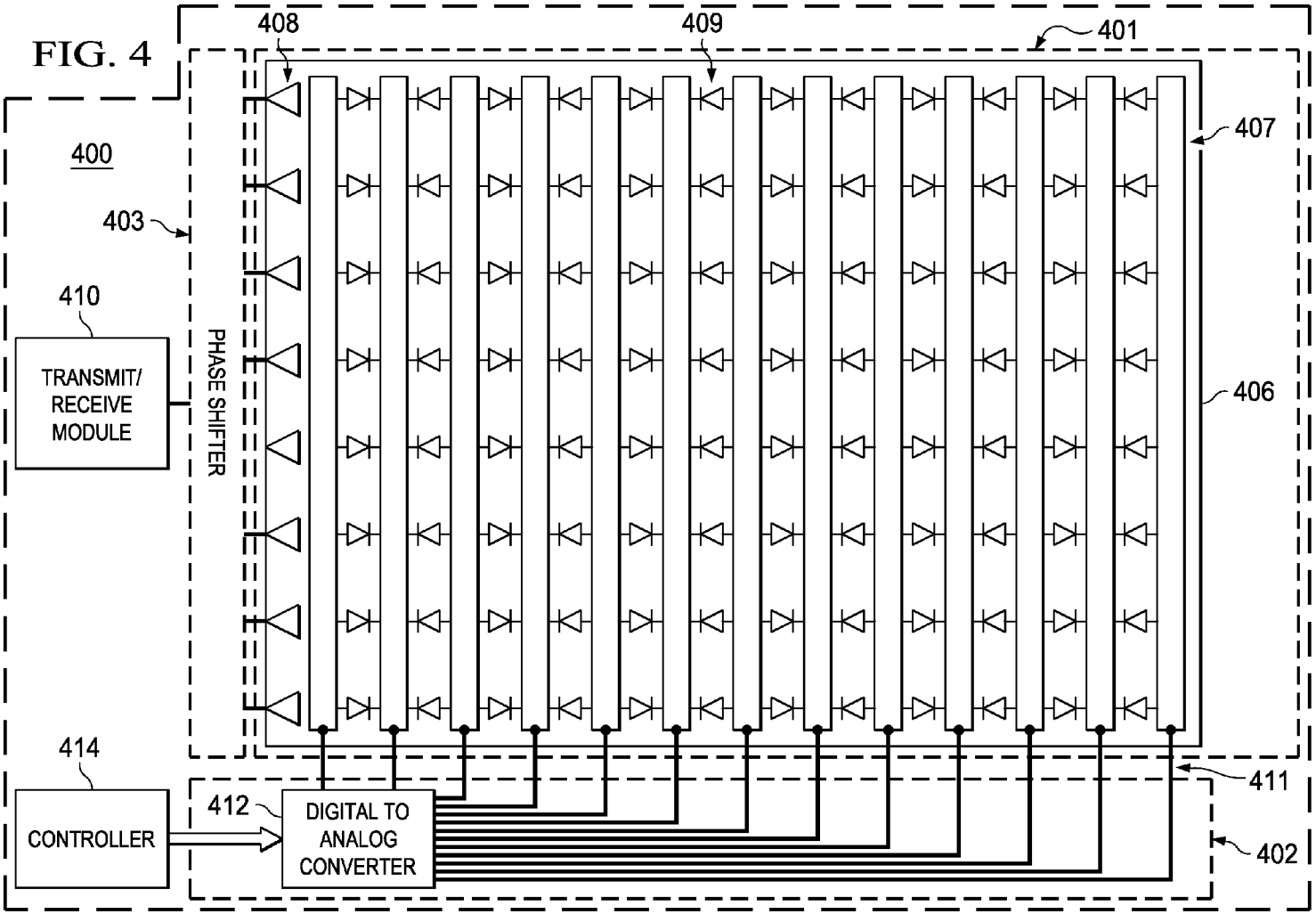
FIG. 4 is an illustration of a different configuration for an antenna system in accordance with an illustrative embodiment.

With reference now to FIG. 4, an illustration of a different configuration for an antenna system is depicted in accordance with an illustrative embodiment. Antenna system 400 may be an example of one implementation for antenna system 100 in FIG. 1. Antenna system 400 includes tunable artificial impedance surface antenna (AISA) 401, which may be an example of one implementation for artificial impedance surface antenna 110 in FIG. 1.

Antenna system 400 and tunable artificial impedance surface antenna 401 may be implemented in a manner similar to antenna system 200 and tunable artificial impedance surface antenna 201, respectively, from FIG. 2. As depicted, antenna system 400 includes tunable artificial impedance surface antenna 401, voltage controller 402, and phase shifter 403. Tunable artificial impedance surface antenna 401 includes dielectric substrate 406, metallic strips 407, varactors 409, and radio frequency surface wave feeds 408. Further, antenna system 400 may include transmit/receive module 410.

However, in this illustrative example, voltage controller 402 may be implemented in a manner different from the manner in which voltage controller 202 is implemented in FIG. 2. In FIG. 4, voltage controller 402 may include voltage lines 411 that allow voltage to be applied from digital to analog converter 412 to each of metallic strips 407. Alternating metallic strips 407 are not grounded as in FIG. 2. Digital to analog converter 412 may receive digital controls from control bus 205 in FIG. 2 from, for example, controller 414, for steering in the theta direction. Controller 414 may be implemented using a microprocessor, a central processing unit, or some other type of computer or processor. Steering in the phi direction may be performed using phase shifter 403 in a manner similar to the manner in which phase shifter 203 is used in FIG. 2.

With voltage lines 411 applying voltage to all of metallic strips 407, twice as many control voltages are required compared to antenna system 200 in FIG. 2. However, the spatial resolution of the impedance modulation of tunable artificial impedance surface antenna 401 is doubled. In this illustrative example, the voltage applied to each of voltage lines 411 is a function of the desired theta steering angle, and may be different for each of voltage lines 411.

Figure 5:
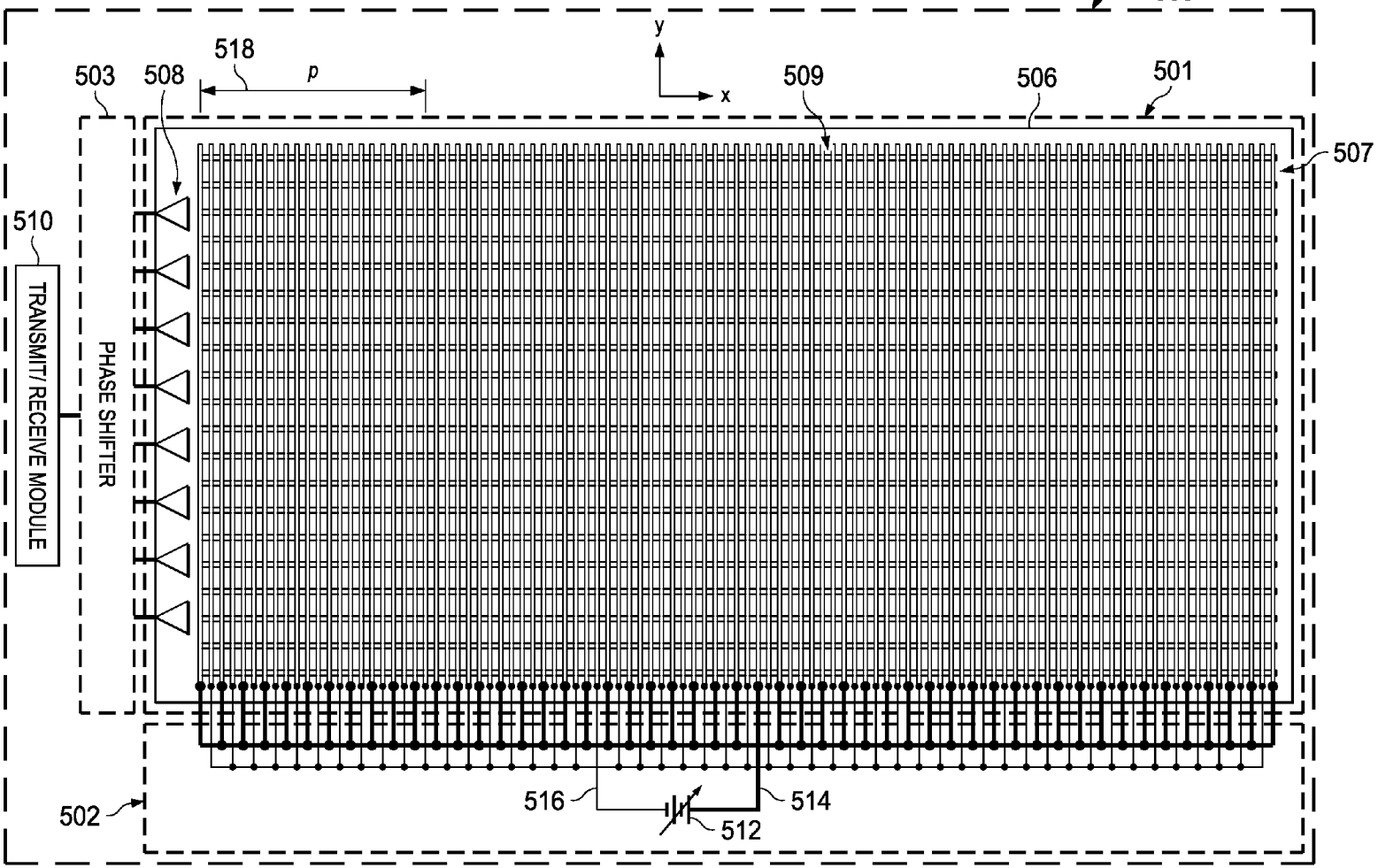
FIG. 5 is an illustration of another configuration for an antenna system in accordance with an illustrative embodiment.

With reference now to FIG. 5, an illustration of another configuration for an antenna system is depicted in accordance with an illustrative embodiment. Antenna system 500 may be an example of one implementation for antenna system 100 in FIG. 1. Antenna system 500 includes tunable artificial impedance surface antenna (AISA) 501, which may be an example of one implementation for artificial impedance surface antenna 110 in FIG. 1.

Antenna system 500 and tunable artificial impedance surface antenna 501 may be implemented in a manner similar to antenna system 200 and tunable artificial impedance surface antenna 201, respectively, from FIG. 2. Further, antenna system 500 and tunable artificial impedance surface antenna 501 may be implemented in a manner similar to antenna system 400 and tunable artificial impedance surface antenna 401, respectively, from FIG. 4.

As depicted, antenna system 500 includes tunable artificial impedance surface antenna 501, voltage controller 502, and phase shifter 503. Tunable artificial impedance surface antenna 501 includes dielectric substrate 506, metallic strips 507, varactors 509, and radio frequency surface wave feeds 508. Further, antenna system 500 may include transmit/receive module 510.

However, in this illustrative example, voltage controller 502 may be implemented in a manner different from the manner in which voltage controller 202 is implemented in FIG. 2 and in a manner different from the manner in which voltage controller 402 is implemented in FIG. 4. In FIG. 5, the digital to analog converters of FIG. 2 and FIG. 4 have been replaced by variable voltage source 512.

As the voltage of variable voltage source 512 is varied, the radiation angle of the beam produced by tunable artificial impedance surface antenna 501 varies between a minimum theta steering angle and a maximum theta steering angle. This range for the theta steering angle may be determined by the details of the design configuration of tunable artificial impedance surface antenna 501.

The voltage is applied to metallic strips 507 through voltage control lines 514 and voltage control lines 516. Voltage control lines 516 may provide a ground for metallic strips 507, while voltage control lines 514 may provide metallic strips 507 with a variable voltage. Across the X dimension, metallic strips 507 are alternately connected to voltage control lines 514 or voltage control lines 516. In other words, alternating metallic strips 507 are grounded.

Metallic strips 507 may have centers that are equally spaced in the X dimension, with the widths of metallic strips 507 periodically varying with a period (p) 518. The number of metallic strips 507 in period 518 may be any number. For example, metallic strips 507 may be between 10 and 20 metallic strips per period 518. The width variation per period 518 may be configured to produce surface wave impedance with a periodic modulation in the X-direction with period 518, such as, for example, the sinusoidal variation of equation (3) described above.

The surface wave impedance at each point on tunable artificial impedance surface antenna 501 is determined by the width of each of metallic strips 507 and the voltage applied to varactors 509. The capacitance of varactors 509 may vary with the varying applied voltage. When the voltage is about 0 volts, the capacitance of a varactor may be at a maximum value of $C_{max}$. The capacitance decreases as the voltage is increased until the capacitance reaches a minimum value of $C_{min}$. As the capacitance is varied, the impedance modulation parameters, X and M, as described in equation 2 above, may also vary from minimum values of $X_{min}$ and $M_{min}$, respectively, to maximum values of $X_{max}$ and $M_{max}$, respectively.

Further, the mean surface wave index of equation 4 described above varies from $n_{min}=\sqrt{(X_{min}/377\Omega)^2+1}$ to $n_{max}=\sqrt{(X_{max}/377\Omega)^2+1}$. Further, as described in equation 3 above, the range that the radiation angle of tunable artificial impedance surface antenna 501 may be scanned may vary from a minimum of $$\theta_{min}=\sin^{-1}(n_{min}-\lambda/p) \tag{5}$$

to a maximum of $$\theta_{max}=\sin^{-1}(n_{max}-\lambda/p) \tag{6}$$

with variation of a single control voltage.

Figure 6:
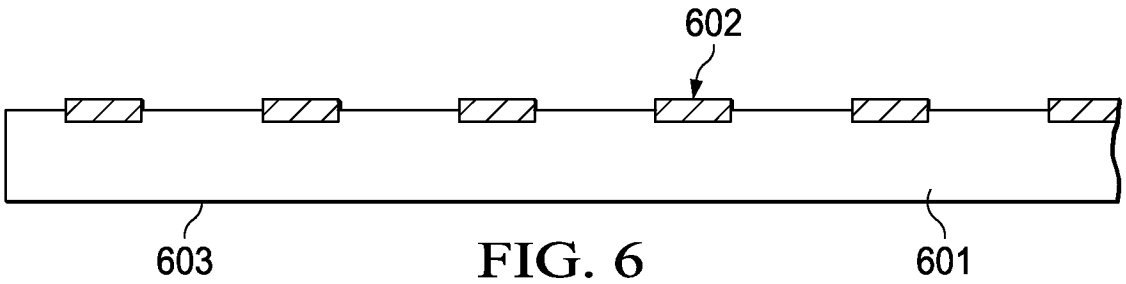
FIG. 6 is an illustration of a side view of a dielectric substrate in accordance with an illustrative embodiment.

With reference now to FIG. 6, an illustration of a side view of a dielectric substrate is depicted in accordance with an illustrative embodiment. In this illustrative example, dielectric substrate 601 may be used to implement dielectric substrate 206 from FIG. 2, dielectric substrate 406 from FIG. 4, and/or dielectric substrate 506 from FIG. 5. Dielectric substrate 601 may have an electrical permittivity that is varied with the application of an electric field.

Metallic strips 602 are shown located on one surface of dielectric substrate 601. As depicted, no varactors are used in this illustrative example. When a voltage is applied to metallic strips 602, an electric field is produced between adjacent metallic strips 602 and also between metallic strips 602 and ground plane 603. The electric field changes the permittivity of dielectric substrate 601, which results in a change in the capacitance between adjacent metallic strips 602. The capacitance between adjacent metallic strips 602 determines the surface wave impedance of the tunable artificial impedance surface antenna that uses dielectric substrate 601.

Figure 7:
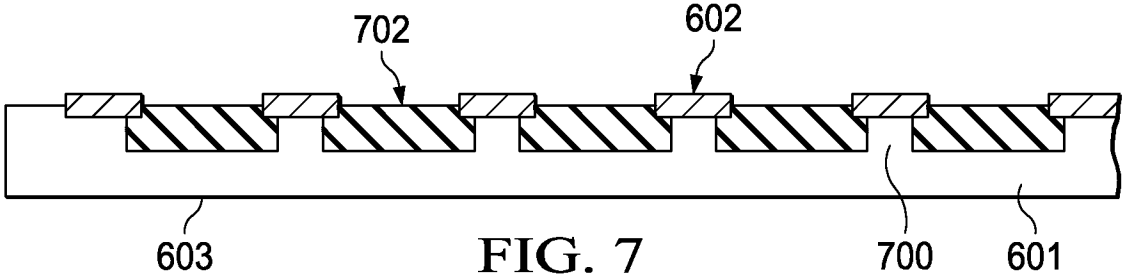
FIG. 7 is an illustration of a dielectric substrate having embedded pockets of material in accordance with an illustrative embodiment.

With reference now to FIG. 7, an illustration of dielectric substrate 601 from FIG. 6 having embedded pockets of material is depicted in accordance with an illustrative embodiment. In this illustrative example, dielectric substrate 601 may take the form of inert substrate 700. A voltage differential may be applied to adjacent metallic strips 602, which may create an electric field between metallic strips 602 and produce a permittivity change in pockets of variable material 702 located between metallic strips 602.

Pockets of variable material 702 may be an example of one manner in which plurality of tunable elements 128 in FIG. 1 may be implemented. The variable material in pockets of variable material 702 may be any electrically variable material, such as, for example, without limitation, a liquid crystal material or barium strontium titanate (BST). In particular, variable material 702 is embedded in pockets within dielectric substrate 601 between metallic strips 602.

Figure 8:
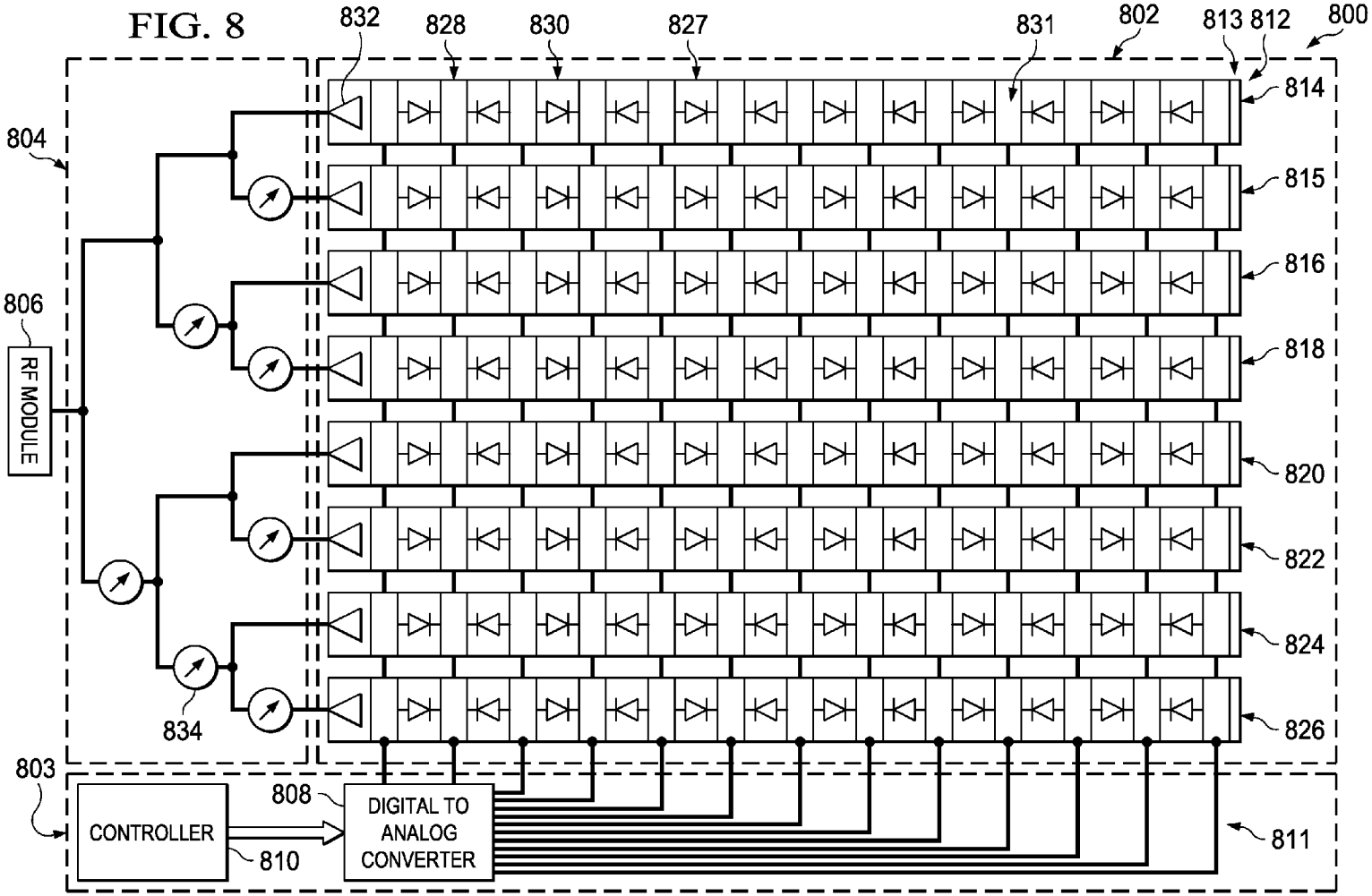
FIG. 8 is an illustration of an antenna system in accordance with an illustrative embodiment.

With reference now to FIG. 8, an illustration of an antenna system is depicted in accordance with an illustrative embodiment. In this illustrative example, antenna system 800 may be an example of one implementation for antenna system 100 in FIG. 1. Antenna system 800 includes antenna 802, voltage controller 803, phase shifter 804, and radio frequency module 806. Antenna 802, voltage controller 803, phase shifter 804, and radio frequency module 806 may be examples of implementations for antenna 102, voltage controller 104, phase shifter 106, and radio frequency module 108, respectively, in FIG. 1.

Antenna 802 is supplied voltage by voltage controller 803. Voltage controller 803 includes digital to analog converter (DAC) 808 and voltage lines 811. Digital to analog converter 808 may be an example of one implementation for a voltage source in number of voltage sources 146 in FIG. 1. Voltage lines 811 may be an example of one implementation for number of voltage lines 150 in FIG. 1.

Voltage may be applied to antenna 802 from digital to analog converter 808 through voltage lines 811. Controller 810 may be used to control the voltage signals sent from digital to analog converter 808 to antenna 802. Controller 810 may be an example of one implementation for controller 151 in FIG. 1. In this illustrative example, controller 810 may be considered part of antenna system 800.

As depicted, antenna 802 may include radiating structure 812 formed by array of radiating elements 813. Array of radiating elements 813 may be an example of one implementation for array of radiating elements 122 in FIG. 1. In this illustrative example, each radiating element in array of radiating elements 813 may be implemented as an artificial impedance surface, surface wave waveguide.

Array of radiating elements 813 may include radiating elements 814, 815, 816, 818, 820, 822, 824, and 826. Each of these radiating elements may be implemented using a dielectric substrate. Further, each of these dielectric substrates may have a plurality of metallic strips, a plurality of varactors, and a surface wave feed located on the surface of the dielectric substrate that forms a surface wave channel for the corresponding radiating element.

As one illustrative example, radiating element 814 may be formed by dielectric substrate 827. Plurality of metallic strips 828 and plurality of varactors 830 may be located on the surface of dielectric substrate 827 to form surface wave channel 831. Further, surface wave feed 832 may be located on the surface of dielectric substrate 827. Plurality of metallic strips 828 and plurality of varactors 830 may be examples of implementations for plurality of metallic strips 132 and plurality of varactors 134, respectively, in FIG. 1.

In the transmitting mode, surface wave feed 832 feeds a surface wave into surface wave channel 831 of radiating element 814. Surface wave channel 831 confines the surface wave to propagate linearly along a confined path across plurality of metallic strips 828. In particular, surface wave channel 831 creates a region of high surface wave index surrounded by a region of lower surface wave index to confine the surface wave to the set path. The surface wave index is the ratio between the speed of light and the propagation speed of the surface wave.

The regions of high surface wave index are created by plurality of metallic strips 828 and plurality of varactors 830, while the regions of low surface wave index are created by the bare surface of dielectric substrate 827. The widths of the regions of high surface wave index may be 50 percent to about 100 percent times the length of the surface wave wavelength. The surface wave wavelength is as follows:

$$\lambda_{sw} = 2\pi n_{sw}\frac{c}{f} \tag{7}$$

where $\lambda_{sw}$ is the surface wave wavelength, f is the frequency of the surface wave, c is the speed of light, and $n_{sw}$ is the surface wave index.

Each of plurality of metallic strips 828 located on dielectric substrate 827 may have the same width. Further, these metallic strips may be equally spaced along dielectric substrate 827. Additionally, plurality of varactors 830 may also be equally spaced along dielectric substrate 827. In other words, plurality of metallic strips 828 and plurality of varactors 830 may be periodically distributed on dielectric substrate 827. Further, plurality of varactors 830 may be aligned such that all of the varactors connections of plurality of metallic strips 828 have the same polarity.

The thickness of dielectric substrate 827 may be determined by its permittivity and the frequency of radiation to be transmitted or received. The higher the permittivity, the thinner dielectric substrate 827 may be.

The capacitance values of plurality of varactors 830 may be determined by the range needed for the desired impedance modulations for the various angles of radiation. The main lobe of the radiation pattern produced by antenna 802 may be electronically steered in the theta direction by applying voltages to the various varactors in array of radiating elements 813. Voltage may be applied to these varactors such that antenna 802 has a surface wave impedance that varies sinusoidally with a distance, x, away from the surface wave feeds on the different dielectric substrates.

Voltage from digital to analog converter 808 may be applied to the metallic strips on array of radiating elements 813 through voltage lines 811. In this illustrative example, surface waves propagated across array of radiating elements 813 may be coupled to phase shifter 804 by the surface wave feeds on array of radiating elements 813. Phase shifter 804 includes plurality of phase-shifting devices 834.

The main lobe of antenna 802 may be electronically steered in the phi direction by imposing a phase shift between each of the surface wave feeds on array of radiating elements 813. If the surface wave feeds are uniformly spaced, the phase shift between adjacent surface wave feeds may be substantially constant. The relation between the phi steering angle and this phase shift may be calculated as follows:

$$\phi = \sin^{-1}\left(\frac{\lambda\Delta\psi}{2\pi d}\right). \tag{8}$$

In other illustrative examples, a radio frequency module, a phase shifter, and a plurality of surface wave feeds may be present on the opposite side of antenna 802 relative to radio frequency module 806. This configuration may be used in order to facilitate steering in the negative theta direction.

Figure 9:
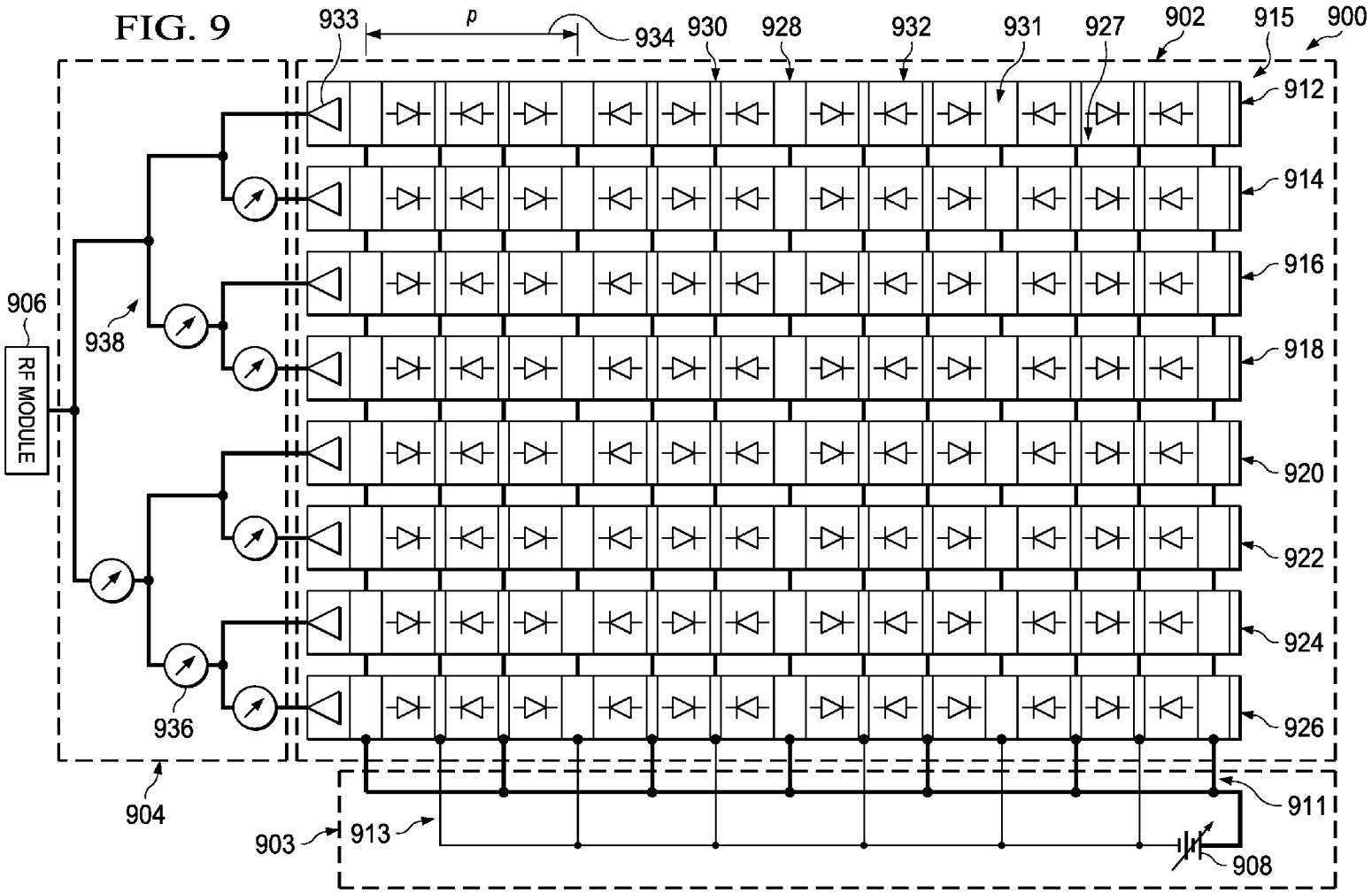
FIG. 9 is another illustration of an antenna system in accordance with an illustrative embodiment.

With reference now to FIG. 9, another illustration of an antenna system is depicted in accordance with an illustrative embodiment. In this illustrative example, antenna system 900 may be an example of one implementation for antenna system 100 in FIG. 1. Antenna system 900 includes antenna 902, voltage controller 903, phase shifter 904, and radio frequency module 906.

Voltage controller 903 is configured to supply voltage to antenna 902. Voltage controller 903 includes variable voltage source 908. Voltage lines 911 apply voltage to antenna 902, while voltage lines 913 provide ground for antenna 902.

Antenna 902 may include array of radiating elements 915 that may include radiating elements 912, 914, 916, 918, 920, 922, 924, and 926. Each of these radiating elements may be implemented using a dielectric substrate. A surface wave channel may be formed on each radiating element by a plurality of metallic strips, a plurality of varactors, and the dielectric substrate.

For example, radiating element 912 may be formed using dielectric substrate 927. First plurality of metallic strips 928, second plurality of metallic strips 930, and plurality of varactors 932 located on the surface of dielectric substrate 927 may form surface wave channel 931. Surface wave feed 933 is also located on the surface of dielectric substrate 927 and couples a surface wave propagated along surface wave channel 931 to phase shifter 904.

Each of first plurality of metallic strips 928 located on array of radiating elements 915 may have the same width. Further, each of second plurality of metallic strips 930 located on array of radiating elements 915 may have the same width. The width of the metallic strips in both first plurality of metallic strips 928 and second plurality of metallic strips 930 varies periodically along dielectric substrate 927 with period, p, 934. This period may be determined by the size of the metallic strips, the radiation frequency, the theta steering angle, and the properties and thickness of dielectric substrate 927.

Although only two widths for the metallic strips are shown within one period, any number of metallic strips may be included within a period. Further, any number of different widths may be included within a period.

Voltage from variable voltage source 908 may be applied to first plurality of metallic strips 928 through voltage lines 911. Second plurality of metallic strips 930 may be grounded through voltage lines 913.

In this illustrative example, surface waves propagated over array of radiating elements 915 may be transmitted to phase shifter 904 as radio frequency signals by the surface wave feeds on array of radiating elements 915. As depicted, phase shifter 904 includes plurality of phase-shifting devices 936.

Transmission lines 938 couple the surface wave feeds to plurality of phase-shifting devices 936 and couple plurality of phase-shifting devices 936 to radio frequency module 906. Radio frequency module 906 may be configured to function as a transmitter, a receiver, or a combination of the two.

Figure 10:
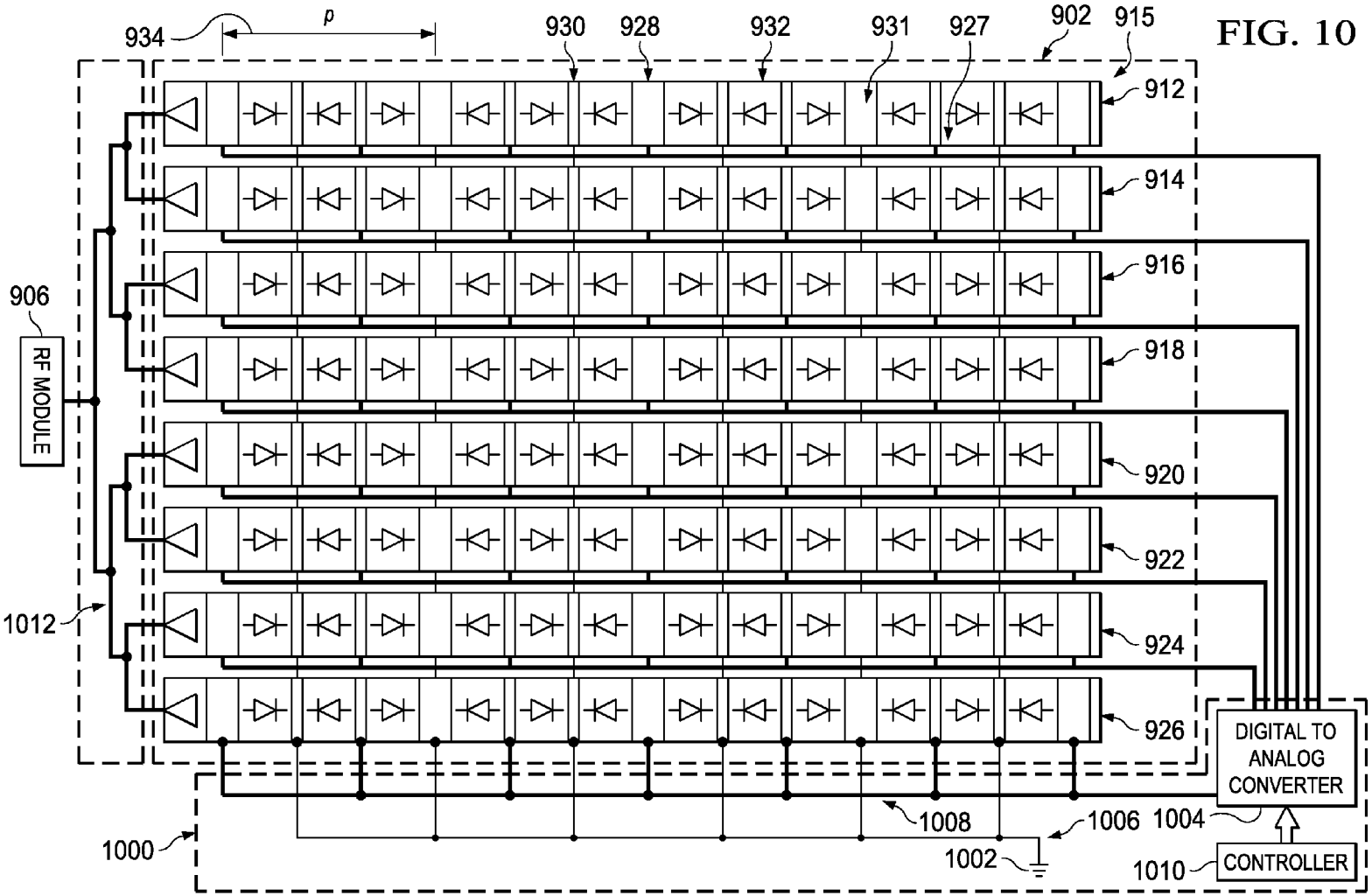
FIG. 10 is an illustration of an antenna system with a different voltage controller in accordance with an illustrative embodiment.

Turning now to FIG. 10, an illustration of antenna system 900 from FIG. 9 with a different voltage controller is depicted in accordance with an illustrative embodiment. In this illustrative example, voltage controller 903 from FIG. 9 has been replaced with voltage controller 1000. Voltage controller 1000 includes ground 1002, digital to analog converter 1004, voltage lines 1006, and voltage lines 1008.

Voltage lines 1006 allow second plurality of metallic strips 930 to be grounded to ground 1002. Voltage lines 1008 supply voltage from digital to analog converter 1004 to first plurality of metallic strips 928. Controller 1010 is used to control digital to analog converter 1004. In this illustrative example, different voltages are sent to each radiating element in array of radiating elements 915.

Further, as depicted, phase shifter 904 is not included in this configuration for antenna system 900. Transmission lines 1012 directly couple radio frequency module 906 to the surface wave feeds on array of radiating elements 915.

In this illustrative example, the radiation pattern created by antenna 902 is steered in the theta direction by controlling the voltages applied to the different varactors in array of radiating elements 915. The radiation pattern created by antenna 902 is steered in the phi direction by the slight variations in surface wave index between neighboring radiating elements. This variation results in phase shifts between the surface waves propagated along these radiating elements, which results in steering in the phi direction.

Figure 11A:
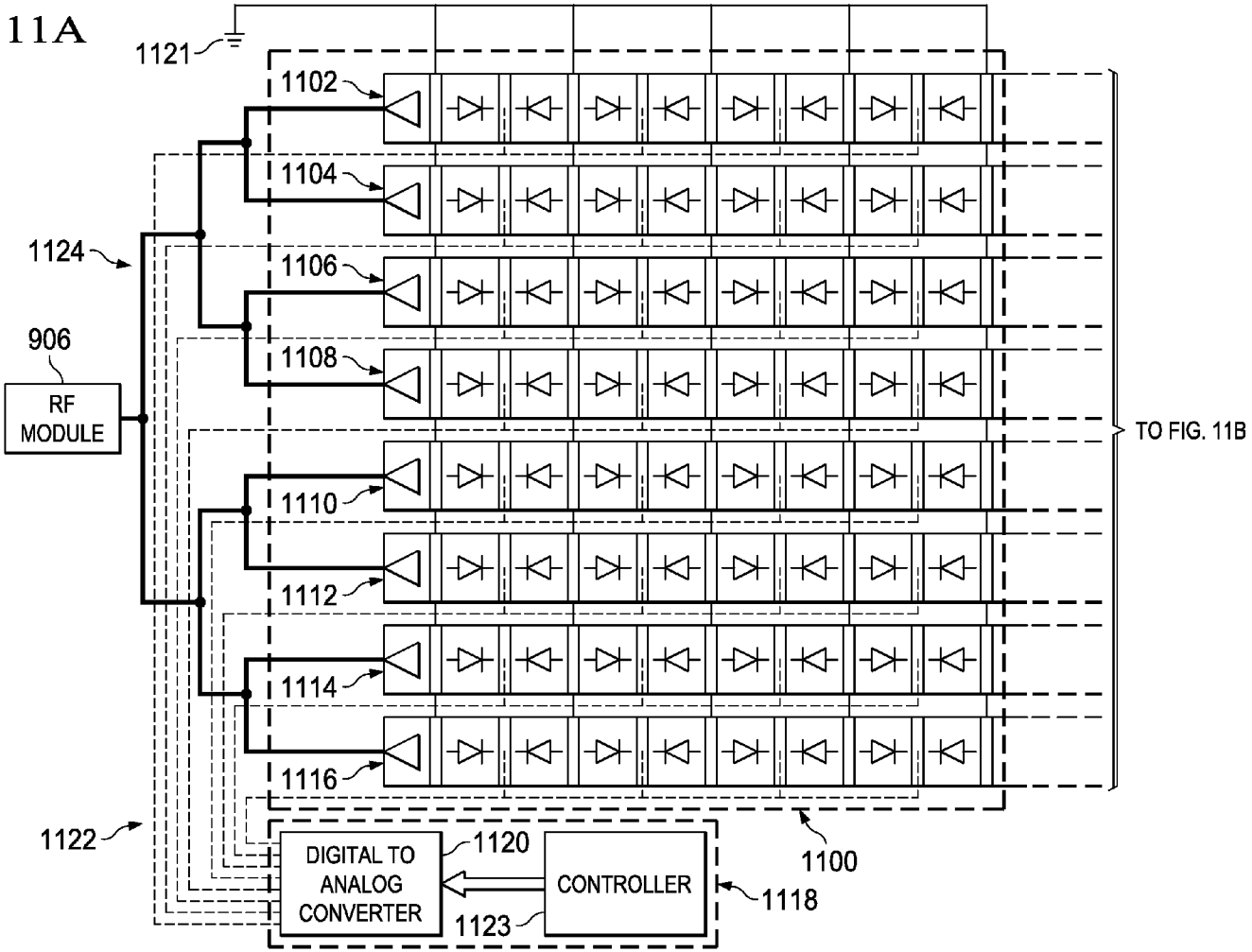
FIGS. 11A and 11B are an illustration of yet another configuration for an antenna system in accordance with an illustrative embodiment.
Figure 11B:
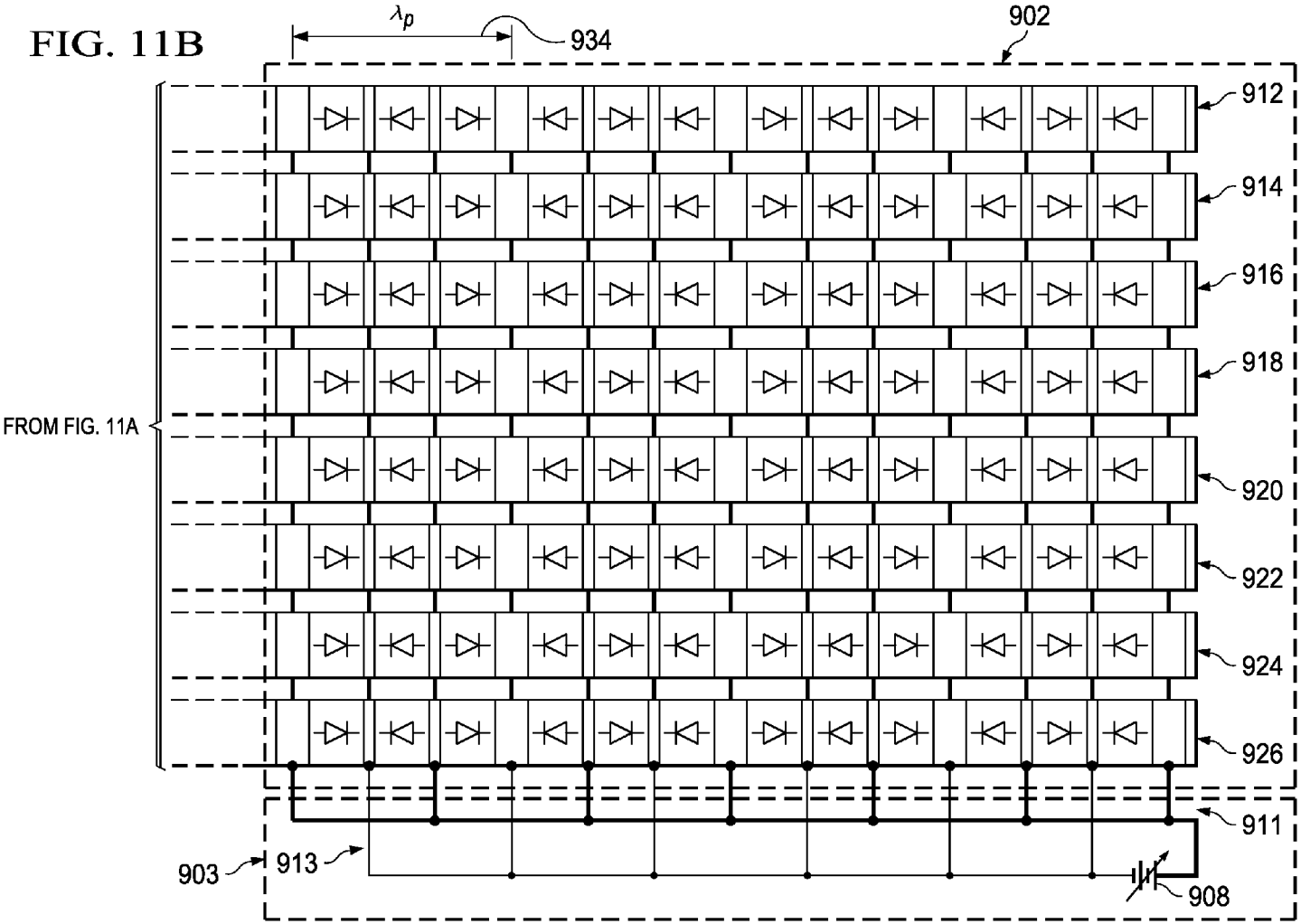

With reference now to FIGS. 11A and 11B, an illustration of yet another configuration for antenna system 900 is depicted in accordance with an illustrative embodiment. In this illustrative example, phase shifter 904 from FIG. 9 has been replaced with phase shifter 1100.

Phase shifter 1100 may be used to control the phi steering angle for antenna system 900. Phase shifter 1100 includes waveguides 1102, 1104, 1106, 1108, 1110, 1112, 1114, and 1116. Each of these waveguides is a surface wave waveguide formed by a plurality of metallic strips and a plurality of varactors located on a dielectric substrate. Voltages may be applied to at least a portion of the metallic strips on the different dielectric substrates to control the phase of the surface waves being propagated along these waveguides to steer the radiation towards the phi steering angle.

The phase of the surface waves may be controlled such that the phase shift of the surface waves at the end of the adjacent waveguides is $\Delta\psi$. The phase of the surface waves at the end of each of the waveguides is varied by controlling the propagation speed of the surface waves. The propagation speed of the surface waves may be controlled by controlling the voltage applied to the varactors on the dielectric substrates.

Voltage controller 1118 may be used to apply voltages to at least a portion of the metallic strips of the dielectric substrates, and thereby, at least a portion of the varactors on the dielectric substrates. Voltage controller 1118 includes digital to analog converter 1120, voltage lines 1122, and ground 1121. Voltages may be applied to at least a portion of the metallic strips on the dielectric substrates from digital to analog converter 1120 by voltage lines 1122. Another portion of the metallic strips may be grounded to ground 1121. Controller 1123 may be used to control digital to analog converter 1120.

The phase of the surface waves at the end of a waveguide may be given by the following equation:

$$\psi(V)=2\pi n_{sw}(V)f/c \tag{9}$$

where $n_{sw}(V)$ is the surface wave index and is dependent on voltage. Each waveguide may be controlled with a different voltage from voltage controller 1118 in order to create a phase difference at the surface wave feeds on the waveguides. The radio frequency signals may be sent between the surface wave feeds and radio frequency module 906 over transmission lines 1124.

Figure 12:
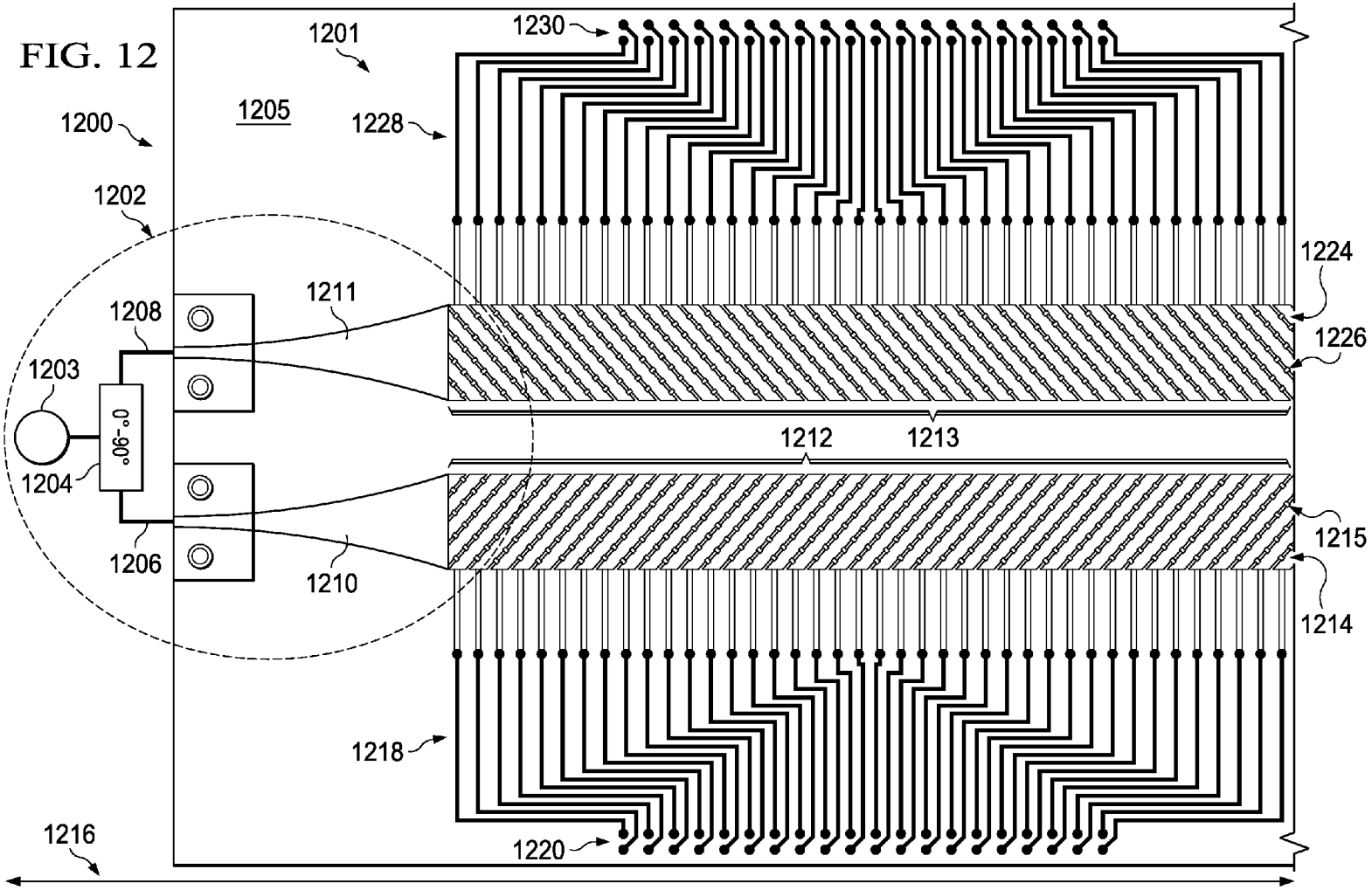
FIG. 12 is an illustration of a portion of an antenna system in accordance with an illustrative embodiment.

With reference now to FIG. 12, an illustration of a portion of an antenna system is depicted in accordance with an illustrative embodiment. In this illustrative example, a portion of antenna system 1200 is depicted. Antenna system 1200 is an example of one implementation of antenna system 100 in FIG. 1. As depicted, antenna system 1200 includes radiating element 1201 and radio frequency assembly 1202.

Radiating element 1201 is an example of one implementation for radiating element 123 in FIG. 1. Further, radiating element 1201 is an example of an implementation for array of radiating elements 122 in FIG. 1 comprising only a single radiating element. Only a portion of radiating element 1201 is shown in this illustrative example. In this example, the radiation pattern produced by antenna system 1200 may only be electronically scanned in the X-Z plane.

In this illustrative example, radio frequency assembly 1202 includes radio frequency module 1203, phase shifting device 1204, transmission line 1206, transmission line 1208, surface wave feed 1210, and surface wave feed 1211. Radio frequency module 1203 may be configured to function as a transmitter, a receiver, or a combination of the two. Phase shifting device 1204 takes the form of a hybrid power splitter in this example. In particular, the hybrid power splitter is configured for use in varying the phase difference between the radio frequency signal traveling along transmission line 1206 and the radio frequency signal traveling along transmission line 1208. In this illustrative example, the hybrid power splitter may be used to vary the phase difference between these two transmission lines between about 0 degrees and about 90 degrees.

Of course, in other illustrative examples, radio frequency module 1203 and phase shifting device 1204 may be implemented in some other manner. For example, radio frequency module 1203 may be configured to enable dual polarization with phase shifting device 1204 taking the form of a four port variable phase power splitter.

Radiating element 1201 is implemented using dielectric substrate 1205. Surface wave channel 1212 and surface wave channel 1213 are formed on dielectric substrate 1205. Surface wave feed 1210 couples transmission line 1206 to surface wave channel 1212. Surface wave feed 1211 couples transmission line 1208 to surface wave channel 1213. Surface wave channel 1212 and surface wave channel 1213 may be examples of implementations for surface wave channel 125 and second surface wave channel 145 in FIG. 1.

As depicted, surface wave channel 1212 is formed by plurality of metallic strips 1214 and plurality of varactors 1215. In this illustrative example, plurality of metallic strips 1214 are periodically arranged at an angle of about positive 45 degrees relative to X-axis 1216. X-axis 1216 is the longitudinal axis along radiating element 1201. Plurality of varactors 1215 are electrically connected to plurality of metallic strips 1214. Voltage lines 1218 are used to apply voltages to plurality of varactors 1215. Pins 1220 may be used to connect voltage lines 1218 to one or more voltage sources and/or one or more grounds.

Further, as depicted, surface wave channel 1213 is formed by plurality of metallic strips 1224 and plurality of varactors 1226. As depicted, plurality of metallic strips 1224 are periodically arranged at an angle of about negative 45 degrees relative to X-axis 1216. Voltage lines 1228 are used to apply voltages to plurality of varactors 1226. Pins 1230 are used to connect voltage lines 1228 to one or more voltage sources and/or one or more grounds.

The radiation pattern formed by radiating element 1201 may be scanned in the X-Z plane by changing the voltages applied to plurality of varactors 1215 such that the surface wave impedance modulation pattern results in the desired radiation angle. Surface wave channel 1212 and surface wave channel 1213 are configured such that the radiation from these two surface wave channels may be orthogonal to each other. The net radiation from the combination of these two surface wave channels is circularly polarized. When fed by phase shifting device 1204 in the form of a 0°-90° hybrid splitter, surface wave channel 1212 and surface wave channel 1213 are fixed into receiving or transmitting circularly-polarized radiation with either right-hand polarization or left-hand polarization. Of course, in other illustrative examples, phase shifting device 1204 may be implemented in some other manner such that the radiation may be switched between left-hand circular polarization (LHCP) and right-hand circular polarization (RHCP).

The radiation from surface wave channel 1212 and surface wave channel 1213 is polarized because of the angles at which plurality of metallic strips 1214 and plurality of metallic strips 1224, respectively, are tilted relative to X-axis 1216. Plurality of metallic strips 1214 and plurality of metallic strips 1224 are tensor impedance elements having a major principal axis that is perpendicular to the long edges of the metallic strips and a minor axis that is along the edges. The local tensor admittance of each surface wave channel in the coordinate frame of the principal axes may be given as follows:

$$Y_{sw} = \begin{bmatrix} Y(x) & 0 \\ 0 & 0 \end{bmatrix}, \tag{10}$$

where $Y_{sw}$ is the local tensor admittance and is determined by the voltage applied to the metallic strips at position x.

The surface wave current, which is along the major principal axis, is as follows:

$$J_{sw} = Y_{sw}E_{sw} = \frac{\begin{bmatrix} Y(x) & 0 \\ 0 & 0 \end{bmatrix} E_{sw} \begin{bmatrix} 1 \\ 1 \end{bmatrix}}{\sqrt{2}} = \frac{E_{sw}}{\sqrt{2}\begin{bmatrix} 1 \\ 0 \end{bmatrix}}, \tag{11}$$

where $J_{sw}$ is the current of the surface wave and $E_{sw}$ is the electric field of the surface wave.

The radiation is driven by the surface wave currents according to the following equation:

$$E_{rad}(\propto[\int[\{\hat{k}\times J_{sw}\}\times\hat{k}]e^{-ik\cdot r'}dx]e^{-ik\cdot r}, \tag{12}$$

and is therefore polarized in the direction across the gaps between the metallic strips. $E_{rad}$ is the electric field of the radiation.

Figure 13:
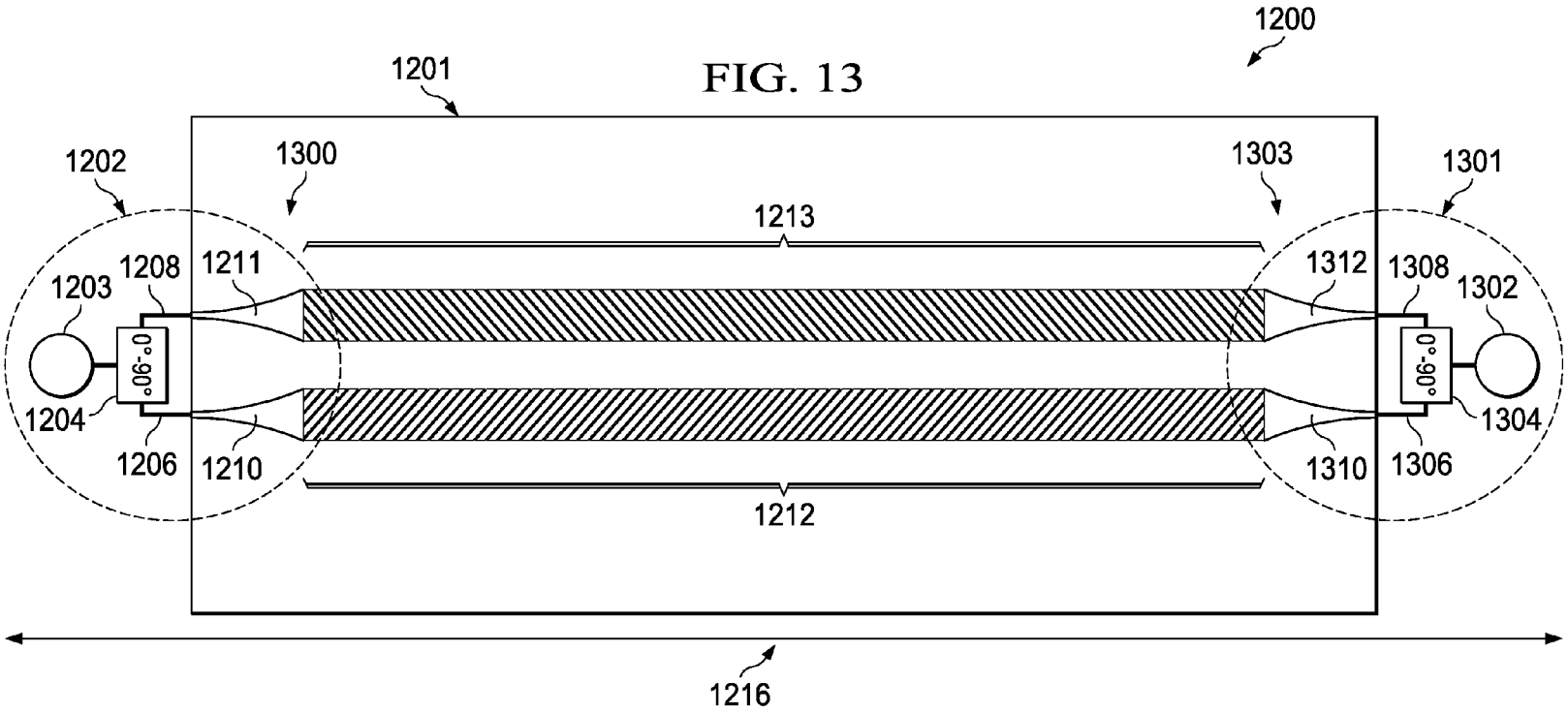
FIG. 13 is an illustration of an antenna system having two radio frequency assemblies in accordance with an illustrative embodiment.

With reference now to FIG. 13, an illustration of antenna system 1200 from FIG. 12 having two radio frequency assemblies is depicted in accordance with an illustrative embodiment. In this illustrative example, radio frequency assembly 1202 is located at end 1300 of radiating element 1201, while radio frequency assembly 1301 is located at end 1303 of radiating element 1201.

Radio frequency assembly 1301 includes radio frequency module 1302, phase shifting device 1304, transmission line 1306, transmission line 1308, surface wave feed 1310, and surface wave feed 1312. Surface wave feed 1310 feeds into surface wave channel 1212. Further, surface wave feed 1312 feeds into surface wave channel 1213.

Either radio frequency assembly 1301 or radio frequency assembly 1202 may function as a sink for any surface wave energy that is not radiated away. In this manner, surface waves may be prevented from reflecting off at the end of radiating element 1201, which would lead to undesired distortion of the radiation pattern.

Further, by having two radio frequency assemblies, the radiation pattern may be more effectively tuned over a larger angular range. Thus, when radiation is to be tilted towards the positive portion of X-axis 1216, radio frequency assembly 1202 may be used to feed the radio frequency signal to radiating element 1201. When radiation is to be tilted towards the negative portion of X-axis 1216, radio frequency assembly 1301 may be used to feed the radio frequency signal to radiating element 1201. In this manner, as the radio frequency beam formed by the radiation pattern is scanned in an angle, beams directed with angles of positive theta and negative theta may be mirror images of each other.

Figure 14:
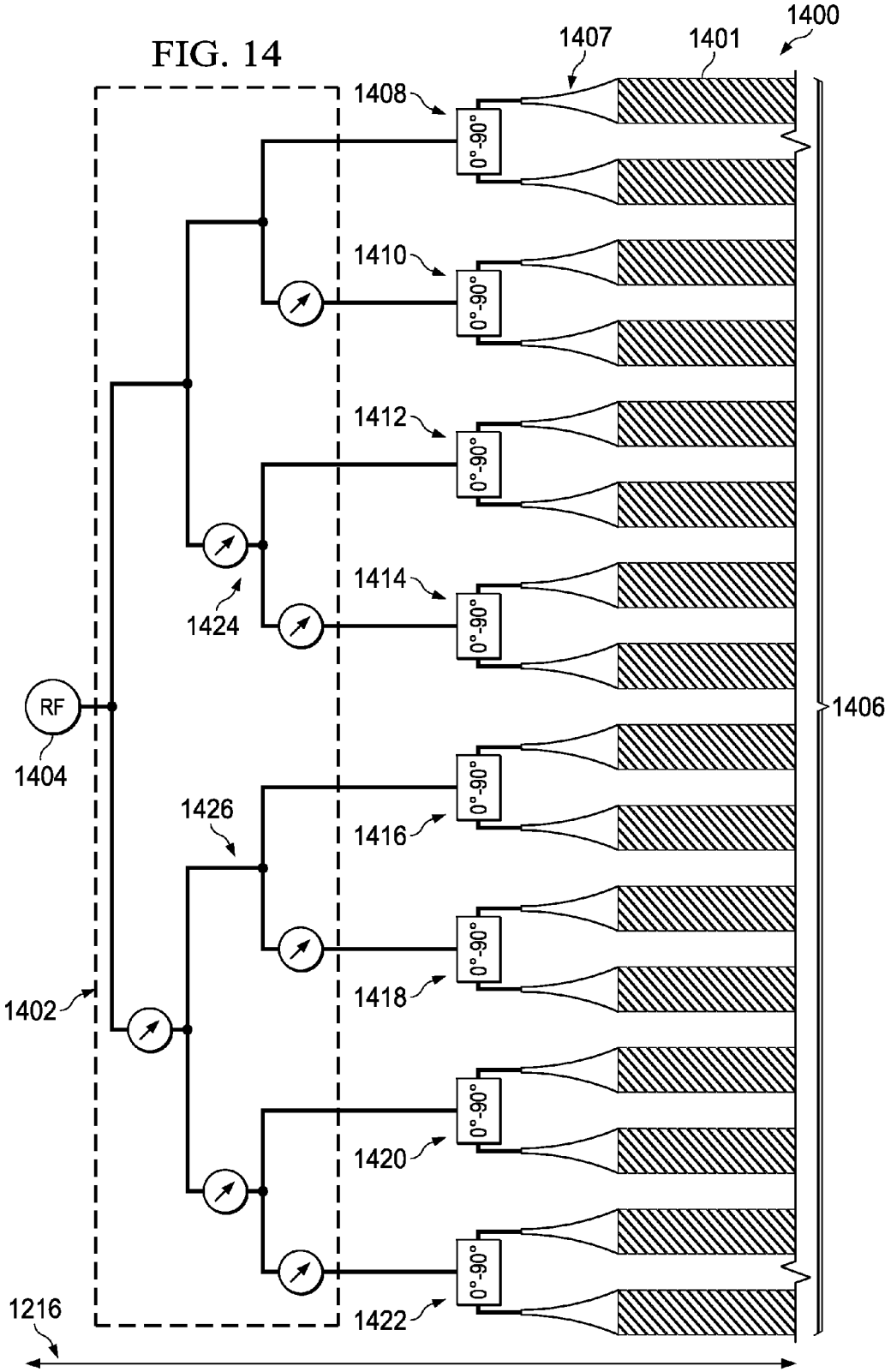
FIG. 14 is an illustration of another antenna system in accordance with an illustrative embodiment.

With reference now to FIG. 14, an illustration of another antenna system is depicted in accordance with an illustrative embodiment. In this illustrative example, antenna system 1400 is another example of one implementation for antenna system 100 in FIG. 1. Antenna system 1400 includes antenna 1401, phase shifter 1402, and radio frequency module 1404. Antenna system 1400 may also include a voltage controller (not shown in this example).

Antenna 1401 includes array of radiating elements 1406 and plurality of surface wave feeds 1407. Array of radiating elements 1406 includes radiating elements 1408, 1410, 1412, 1414, 1416, 1418, 1420, and 1422. Each of these radiating elements may be implemented in a manner similar to radiating element 1201 in FIG. 12.

Plurality of surface wave feeds 1407 couple array of radiating elements 1406 to phase shifter 1402. Phase shifter 1402 includes plurality of phase-shifting devices 1424. Transmission lines 1426 connect plurality of surface wave feeds 1407 to plurality of phase-shifting devices 1424 and connect plurality of phase-shifting devices 1424 to radio frequency module 1404. Radio frequency module 1404 may be configured to function as a transmitter, a receiver, or a combination of the two.

Plurality of phase-shifting devices 1424 are variable phase shifters in this example. In this illustrative example, plurality of phase-shifting devices 1424 may be tuned such that the net phase shift at each one of plurality of surface wave feeds 1407 differs from the phase at a neighboring surface wave feed by a constant, AO. As this constant is varied, the radiation pattern formed may be scanned in the Y-Z plane.

The illustrations in FIGS. 2-14 are not meant to imply physical or architectural limitations to the manner in which an illustrative embodiment may be implemented. Other components in addition to or in place of the ones illustrated may be used. Some components may be optional.

The different components shown in FIGS. 2-14 may be illustrative examples of how components shown in block form in FIG. 1 can be implemented as physical structures. Additionally, some of the components in FIGS. 2-14 may be combined with components in FIG. 1, used with components in FIG. 1, or a combination of the two.

In some cases, it may be desirable to improve the gain of an antenna, such as artificial impedance surface antenna 110 in FIG. 1. The gain of an artificial impedance surface antenna may be improved by improving the accuracy with which the artificial impedance surface antenna is electronically steered to reduce fall off in gain. The illustrative embodiments recognize and take into account that a substantially, radially symmetric arrangement of surface wave channels may allow more accurate electronic steering of the artificial impedance surface antenna. Further, with this type of arrangement, the impedance elements used to form the surface wave channels may be spaced apart greater than half a wavelength. Still further, this type of arrangement may be used to produce radiation of any polarization.

Figure 15:
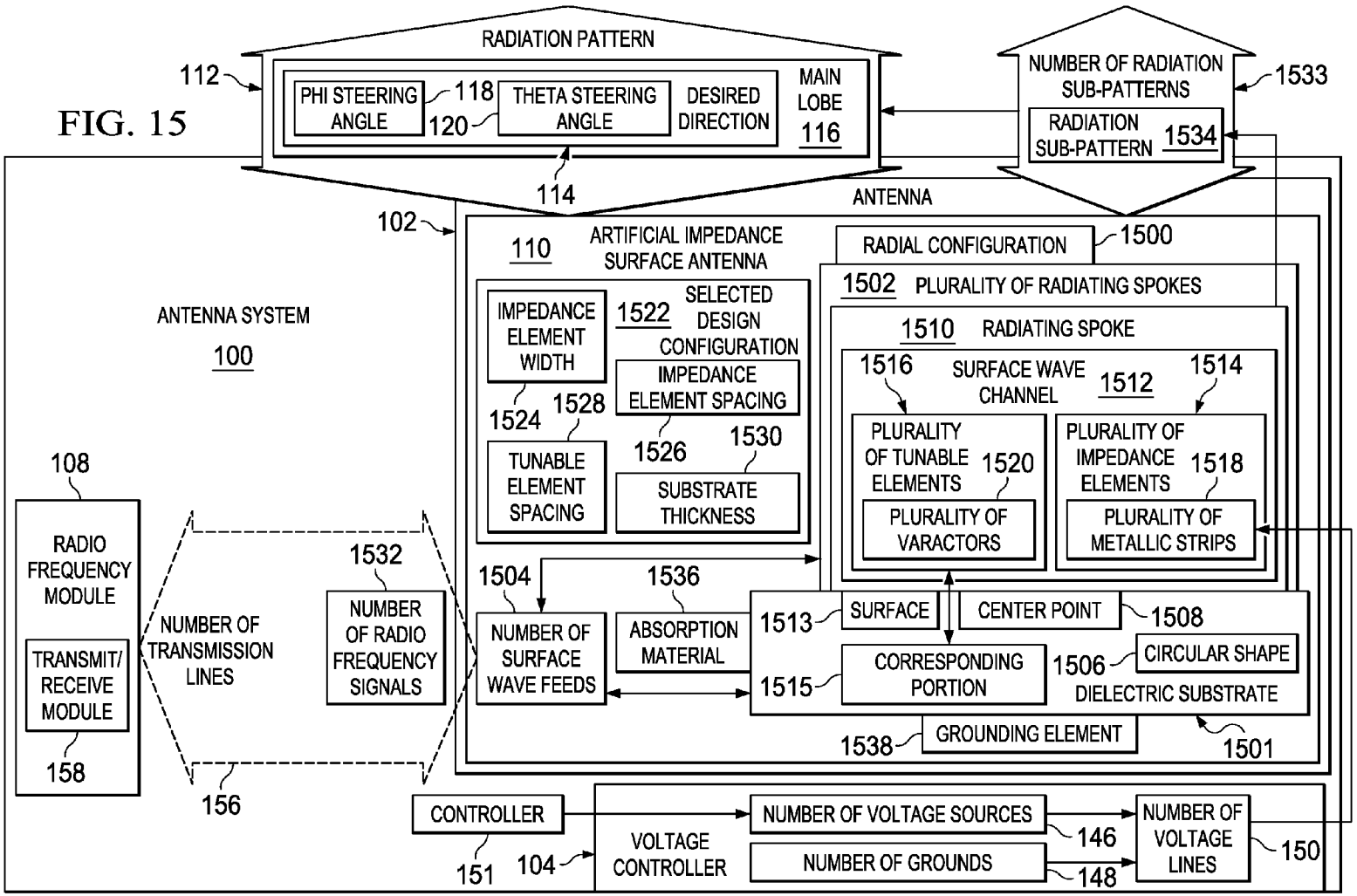
FIG. 15 is an illustration of a different configuration for an artificial impedance surface antenna in an antenna system in the form of a block diagram in accordance with an illustrative embodiment.

With reference now to FIG. 15, an illustration of a different configuration for artificial impedance surface antenna 110 in antenna system 100 from FIG. 1 is depicted in the form of a block diagram in accordance with an illustrative embodiment. Antenna system 100 from FIG. 1 is depicted with artificial impedance surface antenna 110 having radial configuration 1500.

When artificial impedance surface antenna 110 has radial configuration 1500, artificial impedance surface antenna 110 includes dielectric substrate 1501, plurality of radiating spokes 1502, and number of surface wave feeds 1504. Dielectric substrate 1501 may be implemented in a manner similar to dielectric substrate 124 in FIG. 1. However, with radial configuration 1500, dielectric substrate 1501 may be the only dielectric substrate used. Dielectric substrate 1501 may be comprised of any number of layers of dielectric material.

In one illustrative example, dielectric substrate 1501 may be comprised of a material with tunable electrical properties. For example, without limitation, dielectric substrate 1501 may be comprised of a liquid crystal material.

In this illustrative example, dielectric substrate 1501 has circular shape 1506 with center point 1508. In other words, dielectric substrate 1501 may be substantially symmetric about center point 1508. In other illustrative examples, dielectric substrate 1501 may have some other shape. For example, without limitation, dielectric substrate 1501 may have an oval shape, a square shape, a hexagonal shape, an octagonal shape, or some other type of shape. However, when dielectric substrate 1501 is not substantially symmetric about center point 1508, the radiation pattern 112 produced may not have the same gain at different steering angles.

Plurality of radiating spokes 1502 may be implemented using dielectric substrate 1501. In particular, plurality of radiating spokes 1502 may be formed on dielectric substrate 1501.

Plurality of radiating spokes 1502 may be arranged radially with respect to center point 1508 of dielectric substrate 1501. In these illustrative examples, being arranged radially with respect to center point 1508 means that each of plurality of radiating spokes 1502 may extend from center point 1508 towards an outer circumference of dielectric substrate 1501. Each of plurality of radiating spokes 1502 may be arranged substantially perpendicular to a center axis through center point 1508 of dielectric substrate 1501. Further, each of plurality of radiating spokes 1502 may be arranged in a manner such that each radiating spoke is substantially symmetric about center point 1508.

Each of plurality of radiating spokes 1502 may be implemented in a manner similar to radiating element 123 from FIG. 1. Radiating spoke 1510 may be an example of one implementation for each radiating spoke in plurality of radiating spokes 1502. Radiating spoke 1510 is configured to form surface wave channel 1512. In this manner, plurality of radiating spokes 1502 may form a plurality of surface wave channels. Surface wave channel 1512 is configured to constrain a path of a surface wave.

As depicted, radiating spoke 1510 may include plurality of impedance elements 1514 and plurality of tunable elements 1516. Plurality of impedance elements 1514 and plurality of tunable elements 1516 may be implemented in a manner similar to plurality of impedance elements 126 and plurality of tunable elements 128, respectively, from FIG. 1.

In this illustrative example, plurality of impedance elements 1514 and plurality of tunable elements 1516 may be located on surface 1513 of dielectric substrate 1501. In particular, plurality of impedance elements 1514 and plurality of tunable elements 1516 may be located on surface 1513 of corresponding portion 1515 of dielectric substrate 1501.

Plurality of impedance elements 1514, plurality of tunable elements 1516, and corresponding portion 1515 of dielectric substrate 1501 may form an artificial impedance surface from which radiation may be generated. In this illustrative example, corresponding portion 1515 of dielectric substrate 1501 may be considered part of radiating spoke 1510. However, in other illustrative examples, dielectric substrate 1501 may be considered separate from plurality of radiating spokes 1502.

An impedance element in plurality of impedance elements 1514 may be implemented in a number of different ways. In one illustrative example, an impedance element may be implemented as a resonating element. In one illustrative example, an impedance element may be implemented as an element comprised of a conductive material. The conductive material may be, for example, without limitation, a metallic material. Depending on the implementation, an impedance element may be implemented as a metallic strip, a patch of conductive paint, a metallic mesh material, a metallic film, a deposit of a metallic substrate, or some other type of conductive element. In some cases, an impedance element may be implemented as a resonant structure such as, for example, a split-ring resonator (SRR), an electrically-coupled resonator (ECR), a structure comprised of one or more metamaterials, or some other type of structure or element.

Each one of plurality of tunable elements 1516 may be an element that can be controlled, or tuned, to change an angle of radiation pattern 112 produced by radiating spoke 1510. In this illustrative example, each of plurality of tunable elements 1516 may be an element having a capacitance that can be varied based on the voltage applied to the tunable element.

In one illustrative example, plurality of impedance elements 1514 takes the form of plurality of metallic strips 1518 and plurality of tunable elements 1516 takes the form of plurality of varactors 1520. Each of plurality of varactors 1520 may be a semiconductor element diode that has a capacitance dependent on the voltage applied to the semiconductor element diode.

Plurality of metallic strips 1518 may be arranged in a row on corresponding portion 1515 of dielectric substrate 1501 substantially parallel to a plane that is substantially perpendicular to a center axis through center point 1508 of dielectric substrate 1501. For example, plurality of metallic strips 1518 may be periodically distributed on corresponding portion 1515 of dielectric substrate 1501 along an axis that is substantially perpendicular to and that passes through the center axis through dielectric substrate 1501.

In some illustrative examples, plurality of metallic strips 1518 may be printed onto dielectric substrate 1501. For example, plurality of metallic strips 1518 may be printed onto dielectric substrate 1501 using any number of three-dimensional printing techniques, additive deposition techniques, inkjet deposition techniques, or other types of printing techniques.

Plurality of varactors 1520 may be electrically connected to plurality of metallic strips 1518 on surface 1513 of corresponding portion 1515 of dielectric substrate 1501. As one illustrative example, at least one varactor in plurality of varactors 1520 may be positioned between each adjacent pair of metallic strips in plurality of metallic strips 1518. Further, plurality of varactors 1520 may be aligned such that all of the varactor connections on each metallic strip have the same polarity.

Voltages may be applied to plurality of tunable elements 1516 by applying voltages to plurality of impedance elements 1514. In particular, varying the voltages applied to plurality of impedance elements 1514 varies the capacitance of plurality of tunable elements 1516. Varying the capacitances of plurality of tunable elements 1516 may vary, or modulate, the capacitive coupling and impedance between plurality of impedance elements 1514.

Corresponding portion 1515 of dielectric substrate 1501, plurality of impedance elements 1514, and plurality of tunable elements 1516 may be configured with respect to selected design configuration 1522 for surface wave channel 1512 formed by radiating spoke 1510. Depending on the implementation, each radiating spoke in plurality of radiating spokes 1502 may have a same or different selected design configuration.

As depicted, selected design configuration 1522 for radiating spoke 1510 may include a number of design parameters such as, but not limited to, impedance element width 1524, impedance element spacing 1526, tunable element spacing 1528, and substrate thickness 1530. Impedance element width 1524 may be the width of an impedance element in plurality of impedance elements 1514. Impedance element width 1524 may be selected to be the same or different for each of plurality of impedance elements 1514, depending on the implementation.

Impedance element spacing 1526 may be the spacing of plurality of impedance elements 1514 along surface 1513 of corresponding portion 1515 of dielectric substrate 1501. Tunable element spacing 1528 may be the spacing of plurality of tunable elements 1516 along surface 1513 of corresponding portion 1515 of dielectric substrate 1501. Further, substrate thickness 1530 may be the thickness of corresponding portion 1515 of dielectric substrate 1501. In this illustrative example, an entirety of dielectric substrate 1501 may have a substantially same thickness. However, in other illustrative examples, the different portions of dielectric substrate 1501 corresponding to the different radiating spokes in plurality of radiating spokes 1502 may have different thicknesses.

The values for the different parameters in selected design configuration 1522 may be selected based on, for example, without limitation, the radiation frequency at which artificial impedance surface antenna 110 is configured to operate. Other considerations include, for example, the desired impedance modulations for artificial impedance surface antenna 110.

The surface waves propagated along each of plurality of radiating spokes 1502 may be coupled to number of transmission lines 156 by number of surface wave feeds 1504 located on dielectric substrate 1501. Each of number of surface wave feeds 1504 couples at least one corresponding radiating spoke in plurality of radiating spokes 1502 to a transmission line that carries a radio frequency signal, such as one of number of transmission lines 156.

A surface wave feed in number of surface wave feeds 1504 may be any device that is capable of converting a surface wave into a radio frequency signal, a radio frequency signal into a surface wave, or both. In one illustrative example, a surface wave feed in number of surface wave feeds 1504 may be located substantially at center point 1508 of dielectric substrate 1501.

In one illustrative example, number of surface wave feeds 1504 takes the form of a single surface wave feed positioned at center point 1508 of dielectric substrate 1501. This single surface wave feed, which may be referred to as a central feed, may couple each of plurality of radiating spokes 1502 to number of transmission lines 156. In this example, number of transmission lines 156 may take the form of a coaxial cable.

In another illustrative example, number of surface wave feeds 1504 may take the form of a plurality of surface wave feeds located at or near center point 1508 and configured to couple plurality of radiating spokes 1502 to number of transmission lines 156. In this example, number of transmission lines 156 may take the form of a single transmission line or a plurality of transmission lines.

When artificial impedance surface antenna 110 is in a receiving mode, electromagnetic radiation received at artificial impedance surface antenna 110 may be propagated as surface waves along plurality of radiating spokes 1502. These surface waves are received by number of surface wave feeds 1504 and converted into number of radio frequency signals 1532. Number of radio frequency signals 1532 may be sent to radio frequency module 108 over one or more of number of transmission lines 156. Radio frequency module 108 may then process number of radio frequency signals 1532 accordingly.

When artificial impedance surface antenna 110 is in a transmitting mode, number of radio frequency signals 1532 may be sent from radio frequency module 108 to artificial impedance surface antenna 110 over number of transmission lines 156. In particular, number of radio frequency signals 1532 may be received at number of surface wave feeds 1504 and converted into surface waves that are propagated along plurality of radiating spokes 1502.

Radiation pattern 112 of artificial impedance surface antenna 110 may be electronically steered in both a theta direction and a phi direction. Radiation pattern 112 may be formed by number of radiation sub-patterns 1533. Number of radiation sub-patterns 1533 may be produced by a corresponding portion of plurality of radiating spokes 1502. This corresponding portion may be one or more of plurality of radiating spokes 1502. In some cases, number of radiation sub-patterns 1533 may be produced by all of plurality of radiating spokes 1502.

For example, number of radiation sub-patterns 1533 may be produced by a corresponding number of radiating spokes in plurality of radiating spokes 1502. Each of number of radiation sub-patterns 1533 is the radiation pattern produced by a particular radiating spoke. Number of radiating sub-patterns 1533 forms radiation pattern 112. For example, when number of radiating sub-patterns 1533 includes multiple radiating sub-patterns corresponding to multiple radiating spokes, the combination and overlapping of these multiple radiation sub-patterns forms radiation pattern 112.

In this illustrative example, each of plurality of radiating spokes 1502 may be independently controlled such that each of number of radiation sub-patterns 1533 may be electronically steered. For example, without limitation, radiating spoke 1510 may have radiation sub-pattern 1534. Radiation sub-pattern 1534 may be controlled independently of the other radiation sub-patterns formed by the other radiating spokes in plurality of radiating spokes 1502.

As one illustrative example, voltage controller 104 may be used to control the voltages applied to plurality of tunable elements 1516 to control both the theta and phi steering angles of a main lobe of radiation sub-pattern 1534. Similarly, voltage controller 104 may be configured to control the voltages applied to the plurality of tunable elements in each of plurality of radiating spoke 1502 to control both the theta and phi steering angles of a main lobe of the radiation sub-pattern formed by each of plurality of radiating spokes 1502.

Thus, each of number of radiation sub-patterns 1533 may be directed in a particular theta direction and a broad phi direction. For example, a particular radiation sub-pattern may be directed at a theta steering angle of about 45 degrees and may fan out over a broad range of phi angles. In this manner, each radiation sub-pattern may form, for example, a fan beam.

Number of radiation sub-patterns 1533 overlap to form radiation pattern 112 having main lobe 116 directed in a particular phi direction and a particular theta direction. Radiation pattern 112 may be formed such that a beam of radiation is produced. The beam may take the form of, for example, a pencil beam that is directed at a particular phi steering angle 118 and a particular theta steering angle 120. In this manner, artificial impedance surface antenna 110 may be electronically steered in two dimensions.

Depending on the implementation, artificial impedance surface antenna 110 may be configured to emit linearly polarized radiation or circularly polarized radiation. In other words, artificial impedance surface antenna 110 may be used to produce radiation pattern 112 that is linearly polarized or circularly polarized. Further, radiation pattern 112 may be switched between being linearly polarized and circularly polarized by adjusting the voltages applied to plurality of tunable elements 1516 and without needing to change a physical configuration of artificial impedance surface antenna 110.

The impedance sub-patterns produced by the surface wave channels formed by plurality of radiating spokes 1502 may be modulated to produce overall radiation pattern 112 that is linearly polarized. For example, the voltages applied to the tunable elements of each of a corresponding portion of plurality of radiating spokes 1502 may be set such that the impedance sub-pattern produced along the surface wave channel formed by each radiating spoke is given as follows:

$$Z(r,\phi_{swc})=X+M\cos(k_0r(n_0-\cos(\phi_{swc}-\phi_0)\sin(\theta_0))) \tag{13}$$

where $\theta_0$ is the theta angle of the main lobe of the radiation pattern, $\phi_0$ is the phi angle of the main lobe of the radiation pattern, $\phi_{swc}$ is the polar angle of the line that extends along a center of the surface wave channel, r is the radial distance along the surface wave channels, X and M are the mean impedance and the amplitude, respectively, of the modulation of artificial impedance surface antenna 110, and $Z(r, \phi_{swc})$ is the impedance sub-pattern produced along the surface wave channel. This impedance sub-pattern may produce radiation that is linearly polarized in the direction of the theta unit vector, $\hat{\theta}$, where:

$$\hat{\theta}=\sin(\theta)\cos(\phi)\hat{x}+\sin(\theta)\sin(\phi)\hat{y}+\cos(\theta)\hat{z}. \tag{14}$$

In other examples, the impedance sub-patterns of the surface wave channels formed by plurality of radiating spokes 1502 may be modulated to produce overall radiation pattern 112 that is circularly polarized. The voltages applied to the tunable elements of each of a corresponding portion of plurality of radiating spokes 1502 may be set such that the impedance sub-pattern produced by the surface wave channel formed by each radiating spoke is given as follows:

$$Z(r,\phi_{SWC}) = X + M\sin(\gamma \pm \gamma_0)\sqrt{\frac{\cos^2(\varphi)}{\cos^2(\theta_0)} + \sin^2(\Phi)} \tag{15}$$

where $$\phi=\phi_{swc}-\phi_0; \tag{16}$$

$$\gamma=k_0r(n_o-\cos(\phi)\sin(\theta_0)); \tag{17}$$

$$\gamma_0=a\tan(\cos(\theta_0)\tan(\phi)); \text{ and} \tag{18}$$

where the "+" of ± indicates the impedance pattern that produces left-handed circular polarization, and the "−" of ± indicates the impedance pattern that produces right-handed circular polarization.

Equation 15 may be approximated as follows:

$$Z=X+M\sin(\gamma\pm\phi). \tag{19}$$

In other illustrative examples, the impedance sub-patterns may be given by other types of equations involving periodic functions. For example, the sine function of $\sin(\gamma\pm(\phi)$ in Equation (19), the sine function of $\sin(\gamma+\gamma_0)$ in Equation (15), and the cosine function of $\cos(k_0r(n_0-\cos(\phi_{swc}-\phi_0)\sin(\theta_0))$ in Equation (13) may each be replaced by some other type of periodic function.

In this manner, artificial impedance surface antenna 110 may be used to produce radiation of any polarization without requiring a change in the physical configuration of artificial impedance surface antenna 110. Artificial impedance surface antenna 110 may be used to produce linearly polarized or circularly polarized radiation just by changing the voltages applied to the tunable elements of plurality of radiating spokes 1502.

Depending on the implementation, artificial impedance surface antenna 110 may propagate surface waves towards or away from center point 1508 of dielectric substrate 1501. In some illustrative examples, artificial impedance surface antenna 110 may include absorption material 1536 when the surface waves are propagated away from center point 1508. Absorption material 1536 may be located at and around an edge of dielectric substrate 1501. Absorption material 1536 is configured to absorb excess energy from the surface waves propagated radially outward away from center point 1508 through plurality of radiating spokes 1502.

In some illustrative examples, dielectric substrate 1501 may be grounded using grounding element 1538. In particular, grounding element 1538 may be located at an impedance surface of dielectric substrate 1501.

The illustration of antenna system 100 in FIG. 1 is not meant to imply physical or architectural limitations to the manner in which an illustrative embodiment may be implemented. Other components in addition to or in place of the ones illustrated may be used. Some components may be optional. Also, the blocks are presented to illustrate some functional components. One or more of these blocks may be combined, divided, or combined and divided into different blocks when implemented in an illustrative embodiment.

In some illustrative examples, a tunable element in plurality of tunable elements 1516 may be implemented as a pocket of variable material embedded in dielectric substrate 1501. In other illustrative examples, a tunable element in plurality of tunable elements 1516 may be part of a corresponding impedance element in plurality of impedance elements 1514. For example, a resonant structure having a tunable element may be used. The resonant structure may be, for example, without limitation, a split-ring resonator, an electrically-coupled resonator, or some other type of resonant structure.

In other illustrative examples, center point 1508 may be the center point about which plurality of radiating spokes 1502 are arranged but may not be the geometric center of dielectric substrate 1501. For example, center point 1508 may be offset from the geometric center of dielectric substrate 1501.

In yet other illustrative examples, each of plurality of radiating spokes 1502 may have two independently controllable portions configured to form a surface wave channel. For example, radiating spoke 1510 may have a first portion that extends in one direction away from center point 1508 and a second portion that extends in the substantially opposite direction away from center point 1508. These two portions may have a same or different design configuration, depending on the implementation. Further, these two portions may be individually referred to as radiating spokes or radiating sub-spokes in some cases.

Figure 16:
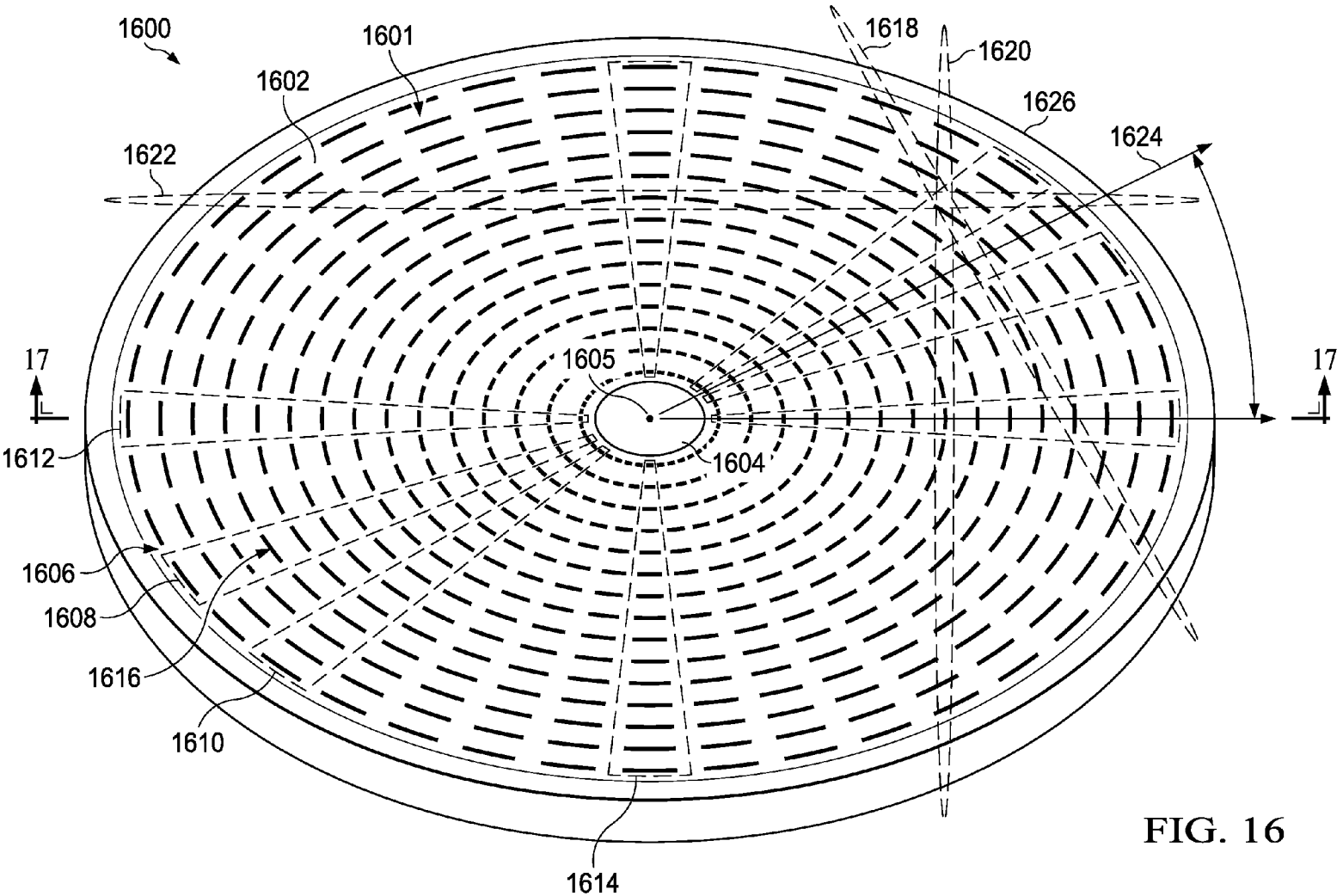
FIG. 16 is an illustration of an artificial impedance surface antenna in accordance with an illustrative embodiment.

With reference now to FIG. 16, an illustration of an artificial impedance surface antenna is depicted in accordance with an illustrative embodiment. In this illustrative example, artificial impedance surface antenna 1600 may be an example of one implementation for artificial impedance surface antenna 110 having radial configuration 1500 in FIG. 15. Artificial impedance surface antenna 1600 has radial configuration 1601, which may be an example of one implementation for radial configuration 1500 in FIG. 15.

As depicted, artificial impedance surface antenna 1600 includes dielectric substrate 1602, central surface wave feed 1604, and plurality of radiating spokes 1606. Dielectric substrate 1602, central surface wave feed 1604, and plurality of radiating spokes 1606 may be examples of implementations for dielectric substrate 1501, number of surface wave feeds 1504, and plurality of radiating spokes 1502, respectively, in FIG. 15.

In this illustrative example, dielectric substrate 1602 has a circular shape with center point 1605. Plurality of radiating spokes 1606 are arranged radially with respect to center point 1605 such that artificial impedance surface antenna 1600 is substantially radially symmetric. Radiating spoke 1608, radiating spoke 1610, radiating spoke 1612, and radiating spoke 1614 may be examples of some of plurality of radiating spokes 1606.

Plurality of radiating spokes 1606 are formed by impedance elements 1616 that have been printed on dielectric substrate 1602. Impedance elements 1616 take the form of metallic strips in this illustrative example. Plurality of radiating spokes 1606 may also include tunable elements (not shown in this view) located between impedance elements 1616.

Central surface wave feed 1604 may couple plurality of radiating spokes 1606 to a transmission line (not shown in this view). The transmission line may be configured to carry a radio frequency to, from, or both to and from central surface wave feed 1604.

Artificial impedance surface antenna 1600 may be electronically steered with a desired level of accuracy in a theta direction and a phi direction. Each of plurality of radiating spokes 1606 may be individually electronically steered in a particular theta direction and a broad phi direction to produce a fan beam. For example, radiating spoke 1608, radiating spoke 1612, and radiating spoke 1614 may be electronically steered to produce fan beam 1618, fan beam 1620, and fan beam 1622, respectively. The radiation patterns corresponding to fan beam 1618, fan beam 1620, and fan beam 1622 may overlap such that pencil beam 1624 is produced. Pencil beam 1624 may be directed at a particular theta steering angle and a particular phi steering angle.

As depicted, absorption material 1626 is located at and around an outer edge of dielectric substrate 1602. Absorption material 1626 may be an example of one implementation for absorption material 1536 in FIG. 15. Absorption material 1626 is configured to absorb excess energy resulting from surface waves propagating away from center point 1605.

Figure 17:
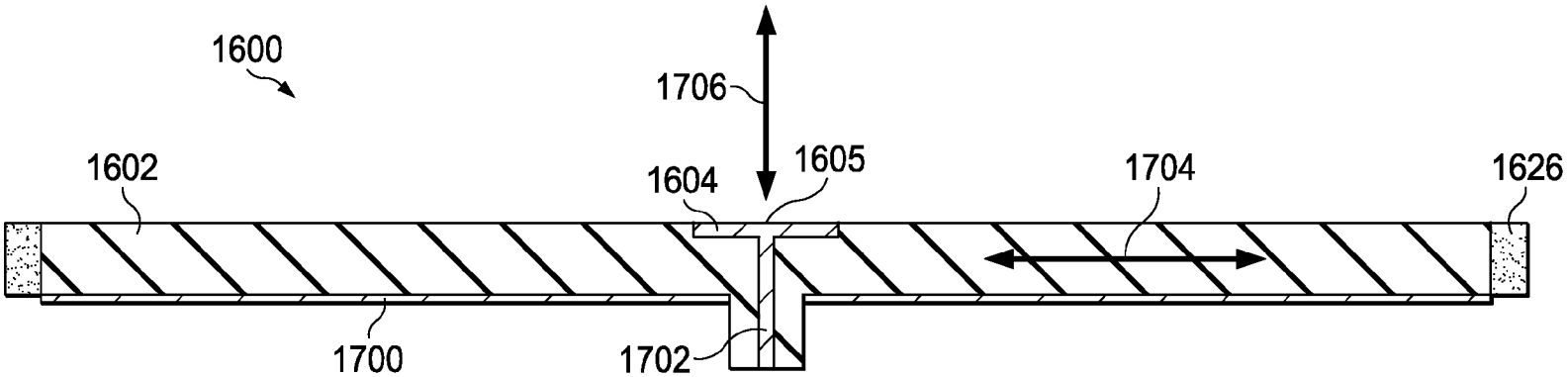
FIG. 17 is an illustration of a cross-sectional side view of an artificial impedance surface antenna in accordance with an illustrative embodiment.

With reference now to FIG. 17, an illustration of a cross-sectional side view of artificial impedance surface antenna 1600 from FIG. 16 is depicted in accordance with an illustrative embodiment. In this illustrative example, a cross-sectional side view of artificial impedance surface antenna 1600 from FIG. 16 is depicted taken with respect to cross-section lines 17-17 in FIG. 17.

In this illustrative example, grounding element 1700 may be seen along the surface of dielectric substrate 1602. Grounding element 1700 is an example of one implementation for grounding element 1538 in FIG. 15.

Transmission line 1702 is also shown in this view. Transmission line 1702 may carry a radio frequency to, from, or both to and from central surface wave feed 1604. In one illustrative example, transmission line 1702 takes the form of a coaxial cable.

As depicted, surface waves may propagate in the direction of arrow 1704, substantially parallel to dielectric substrate 1602 and substantially perpendicular to center axis 1706 through center point 1605 of dielectric substrate 1602. Plurality of radiating spokes 1606 (not shown in this view) may be arranged such that plurality of radiating spokes 1606 are substantially symmetric about center axis 1706.

Figure 18:
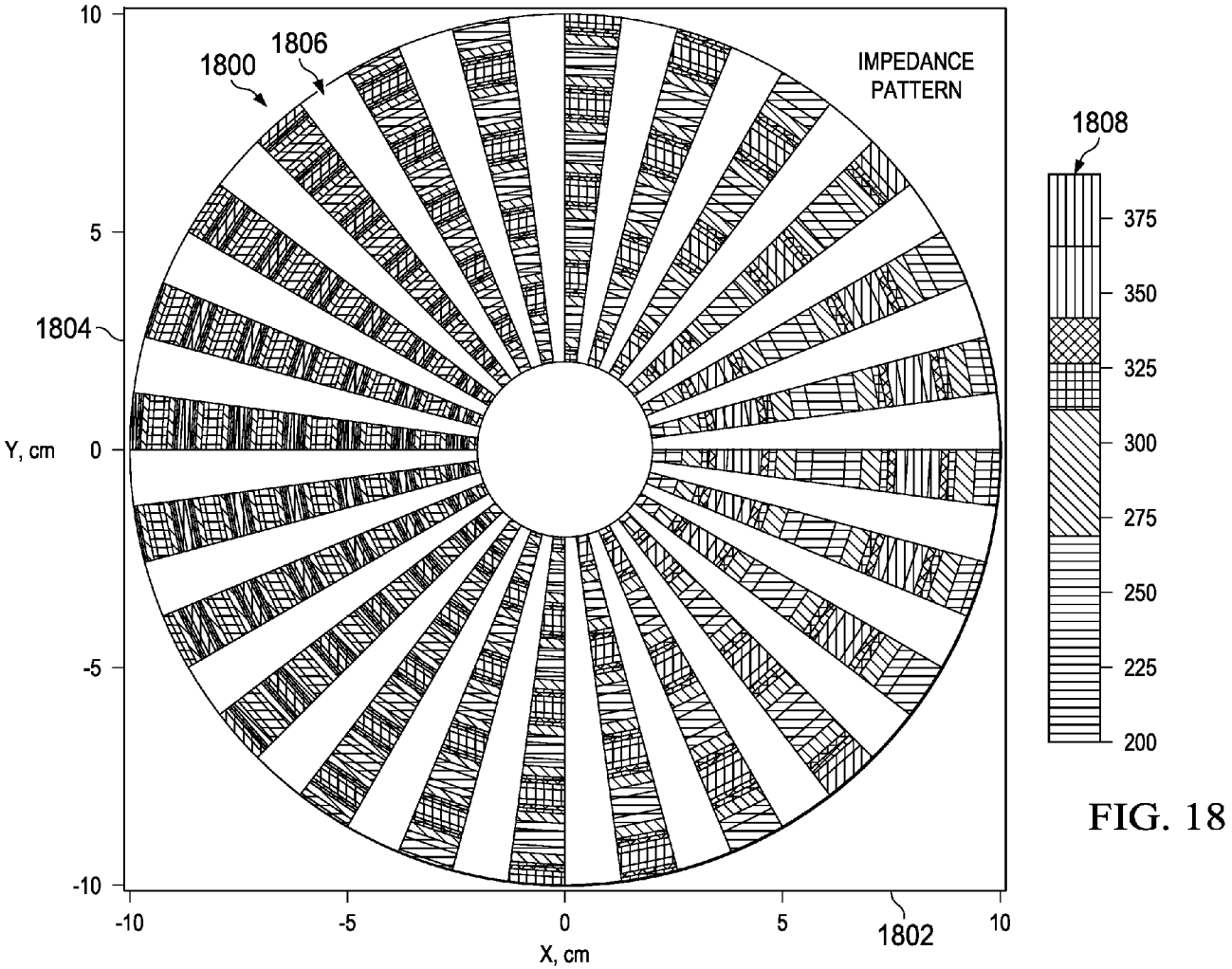
FIG. 18 is an illustration of an impedance pattern for an artificial impedance surface antenna in accordance with an illustrative embodiment.

With reference now to FIG. 18, an illustration of an impedance pattern for artificial impedance surface antenna 1600 from FIGS. 16-17 is depicted in accordance with an illustrative embodiment. In this illustrative example, impedance pattern 1800 may be produced when artificial impedance surface antenna 1600 is linearly polarized and configured to produce a radiation pattern having a main lobe directed at a theta steering angle of about 45 degrees and a phi steering angle of about 0 degrees.

Impedance pattern 1800 is shown with respect to first axis 1802 and second axis 1804. First axis 1802 and second axis 1804 may represent the two axes that form the plane substantially parallel to dielectric substrate 1602 in FIG. 16. Impedance pattern 1800 is comprised of impedance sub-patterns 1806 formed by plurality of radiating spokes 1606 in FIG. 16. Scale 1808 provides the correlation between the impedance sub-patterns 1806 and impedance values. The impedance values may be in units of j-Ohms in which j is equal to $\sqrt{-1}$.

Figure 19:
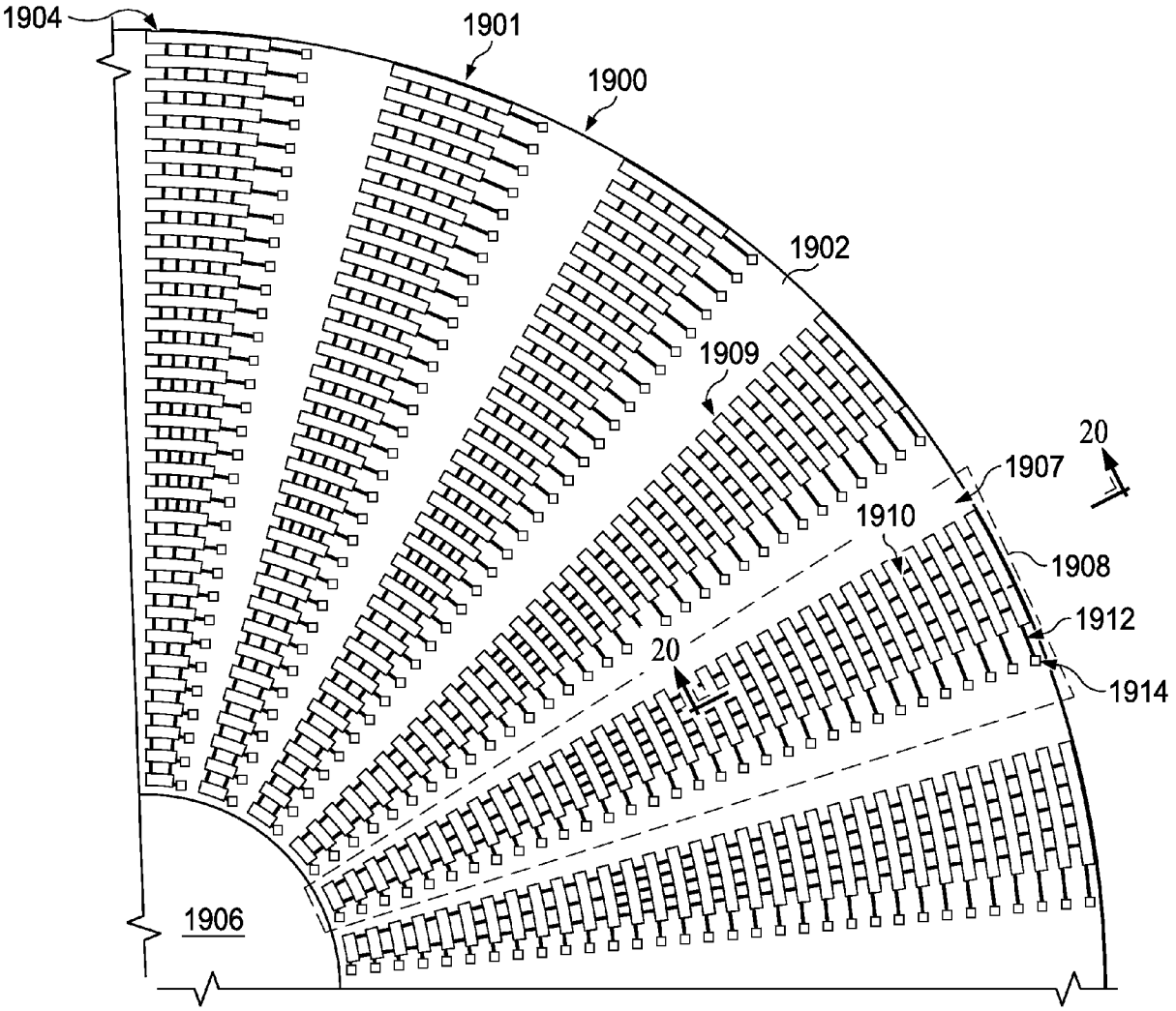
FIG. 19 is an illustration of a portion of an artificial impedance surface antenna in accordance with an illustrative embodiment.

With reference now to FIG. 19, an illustration of a portion of an artificial impedance surface antenna is depicted in accordance with an illustrative embodiment. In this illustrative example, artificial impedance surface antenna 1900 may be another example of one implementation for artificial impedance surface antenna 110 having radial configuration 1500 in FIG. 15. Artificial impedance surface antenna 1900 has radial configuration 1901, which may be an example of one implementation for radial configuration 1500 in FIG. 15.

In this illustrative example, artificial impedance surface antenna 1900 includes dielectric substrate 1902, radiating spokes 1904, and central surface wave feed 1906. Only a portion of the total plurality of radiating spokes that form artificial impedance surface antenna 1900 are shown in this view.

Radiating spoke 1907 is an example of one of radiating spokes 1904. Only a portion of radiating spoke 1907 is shown. Radiating spoke 1907 is located on corresponding portion 1908 of dielectric substrate 1902. Radiating spoke 1907 includes plurality of metallic strips 1909 and plurality of varactors 1910. Plurality of metallic strips 1909 and plurality of varactors 1910 may be an example of one implementation for plurality of metallic strips 1518 and plurality of varactors 1520, respectively, in FIG. 15.

As depicted, voltages may be applied to plurality of metallic strips 1909, and thereby plurality of varactors 1910, through conductive lines 1912, which terminate at terminals 1914. Terminals 1914 may be connected to electrical vias (not shown in this view) that pass through the thickness of dielectric substrate 1902 and through a grounding element (not shown in this view) to connectors that connect to control hardware, such as a voltage controller.

Figure 20:
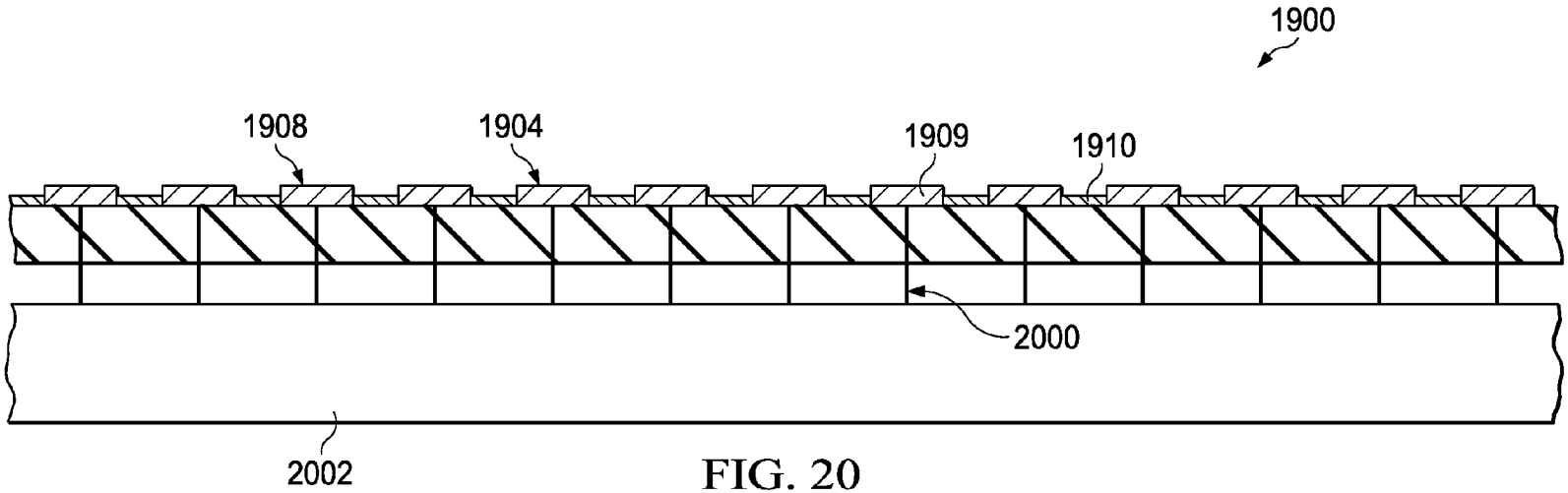
FIG. 20 is an illustration of a cross-sectional side view of an artificial impedance surface antenna in accordance with an illustrative embodiment.

With reference now to FIG. 20, an illustration of a cross-sectional side view of artificial impedance surface antenna 1900 from FIG. 19 is depicted in accordance with an illustrative embodiment. In this illustrative example, a cross-sectional side view of artificial impedance surface antenna 1900 from FIG. 19 is depicted taken with respect to cross-section lines 20-20 in FIG. 19.

In this illustrative example, electrical vias 2000 that connect terminals 1914 in FIG. 19 to voltage controller 2002 are shown. Voltage controller 2002 may vary the voltages applied to the metallic strips of plurality of radiating spokes 1904 in FIG. 19.

Figure 21:
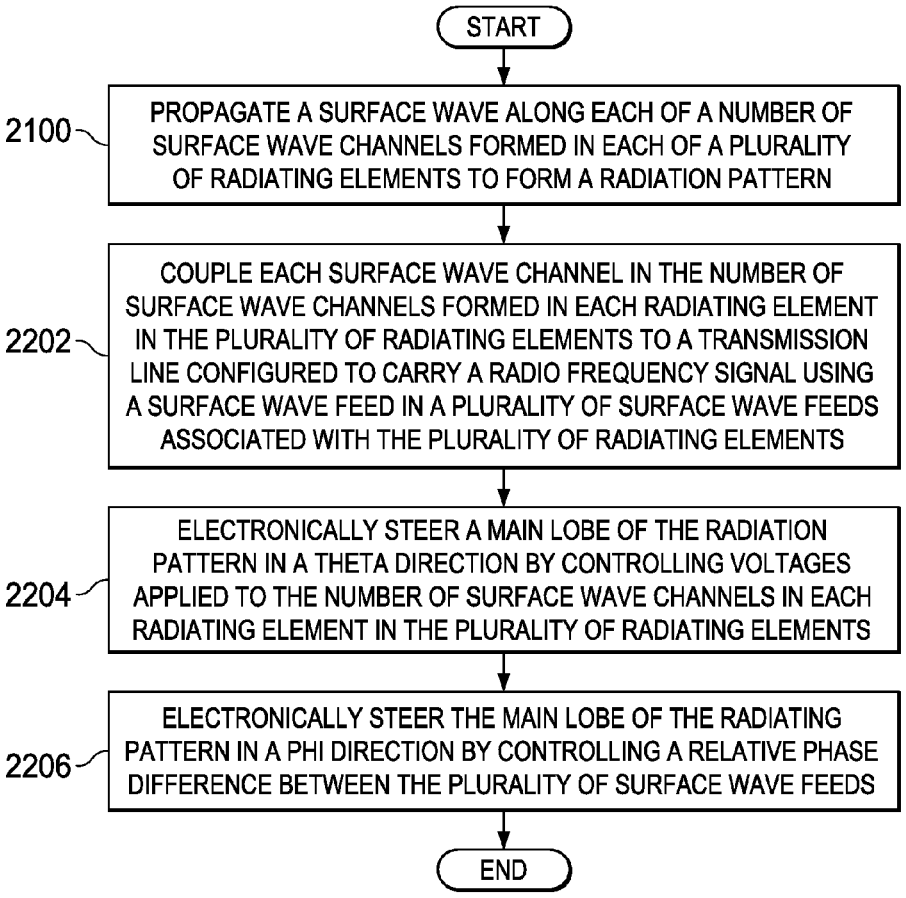
FIG. 21 is an illustration an illustration of a process for electronically steering an antenna system in the form of a flowchart in accordance with an illustrative embodiment.

Turning now to FIG. 21, an illustration of a process for electronically steering an antenna system is depicted in the form of a flowchart in accordance with an illustrative embodiment. The process illustrated in FIG. 21 may be implemented to electronically steer antenna system 100 in FIG. 1.

The process begins by propagating a surface wave along each of a number of surface wave channels formed in each of a plurality of radiating elements to form a radiation pattern (operation 2100). Each surface wave channel in the number of surface wave channels formed in each radiating element in the plurality of radiating elements is coupled to a transmission line configured to carry a radio frequency signal using a surface wave feed in a plurality of surface wave feeds associated with the plurality of radiating elements (operation 2102).

Thereafter, a main lobe of the radiation pattern is electronically steered in a theta direction by controlling voltages applied to the number of surface wave channels in each radiating element in the plurality of radiating elements (operation 2104). Further, the main lobe of the radiation pattern is electronically steered in a phi direction by controlling a relative phase difference between the plurality of surface wave feeds (operation 2106), with the process terminating thereafter.

Figure 22:
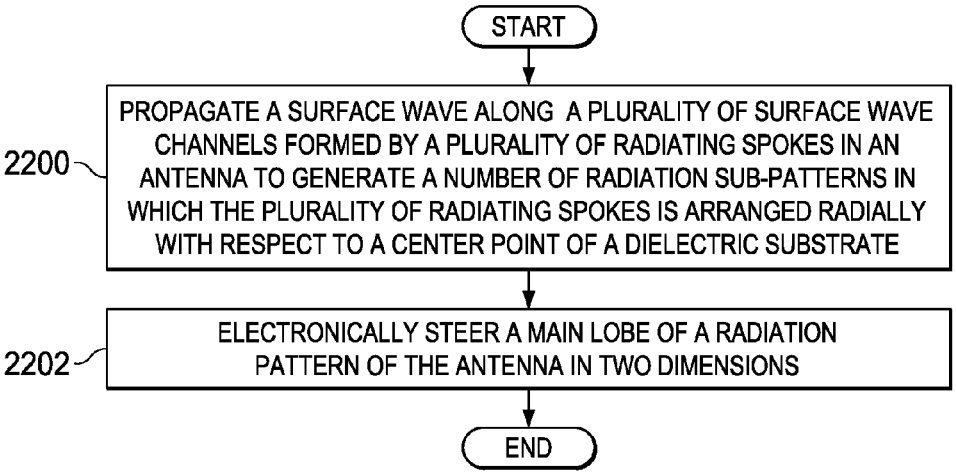
FIG. 22 is an illustration of a process for electronically steering an antenna system in the form of a flowchart in accordance with an illustrative embodiment.

With reference now to FIG. 22, an illustration of a process for electronically steering an antenna system is depicted in the form of a flowchart in accordance with an illustrative embodiment. The process illustrated in FIG. 22 may be implemented to electronically steer, for example, artificial impedance surface antenna 110 having radial configuration 1500 in FIG. 15.

The process begins by propagating a surface wave along a plurality of surface wave channels formed by a plurality of radiating spokes in an antenna to generate a number of radiation sub-patterns in which the plurality of radiating spokes is arranged radially with respect to a center point of a dielectric substrate (operation 2200). Next, a main lobe of a radiation pattern of the antenna is electronically steered in two dimensions (operation 2202), with the process terminating thereafter.

The flowcharts and block diagrams in the different depicted embodiments illustrate the architecture, functionality, and operation of some possible implementations of apparatuses and methods in an illustrative embodiment. In this regard, each block in the flowcharts or block diagrams may represent a module, a segment, a function, and/or a portion of an operation or step.

In some alternative implementations of an illustrative embodiment, the function or functions noted in the blocks may occur out of the order noted in the figures. For example, in some cases, two blocks shown in succession may be executed substantially concurrently, or the blocks may sometimes be performed in the reverse order, depending upon the functionality involved. Also, other blocks may be added in addition to the illustrated blocks in a flowchart or block diagram.

The description of the different illustrative embodiments has been presented for purposes of illustration and description, and is not intended to be exhaustive or limited to the embodiments in the form disclosed. Many modifications and variations will be apparent to those of ordinary skill in the art. Further, different illustrative embodiments may provide different features as compared to other desirable embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. An apparatus comprising:

a dielectric substrate;

a plurality of radiating spokes arranged radially with respect to a center point of the dielectric substrate, wherein each radiating spoke in the plurality of radiating spokes forms a surface wave channel configured to constrain a path of a surface wave, and wherein each of the plurality of radiating spokes comprises:

a plurality of tunable elements located on a surface of the dielectric substrate; and a plurality of impedance elements located on the surface of the dielectric substrate and electrically connected to the plurality of impedance elements; and a number of surface wave feeds, wherein each of the number of surface wave feeds couples at least one corresponding radiating spoke in the plurality of radiating spokes to a transmission line that carries a radio frequency signal.

2. The apparatus of claim 1, wherein the dielectric substrate, the plurality of radiating spokes, and the number of surface wave feeds form an artificial impedance surface antenna that can be electronically steered in a particular theta direction and a particular phi direction.

3. The apparatus of claim 2, wherein a number of radiation sub-patterns formed by a corresponding portion of the plurality of radiating spokes overlap such that the artificial impedance surface antenna has a radiation pattern with a main lobe directed in the particular theta direction and the particular phi direction.

4. The apparatus of claim 1, further comprising:

a voltage controller configured to control voltages applied to the plurality of tunable elements to control a theta steering angle of a main lobe of a radiation sub-pattern produced by each radiating spoke.

5. The apparatus of claim 1, wherein each of the plurality of impedance elements is selected from one of a metallic strip, a patch of conductive paint, a metallic mesh material, a metallic film, a deposit of a metallic substrate, a resonant structure, a split-ring resonator, an electrically-coupled resonator, and a structure comprised of one or more metamaterials, and wherein each of the plurality of tunable elements is selected from one of a varactor and a pocket of variable material.

6. The apparatus of claim 1, wherein the plurality of impedance elements is printed on the surface of a corresponding portion of the dielectric substrate.

7. The apparatus of claim 1, wherein each of the plurality of radiating spokes is configured to radiate a fan beam in a particular theta direction and a broad phi direction.

8. The apparatus of claim 1, wherein the surface wave channel forms linearly polarized radiation.

9. The apparatus of claim 1, wherein surface wave channels formed by the plurality of radiating spokes produce circularly polarized radiation.

10. The apparatus of claim 1, wherein voltages applied to the plurality of radiating spokes are set such that the plurality of radiating spokes produce an overall radiation pattern that is one of circularly polarized and linearly polarized.

11. The apparatus of claim 1 further comprising:

an absorption material located at an edge of the dielectric substrate, wherein the absorption material absorbs excess energy from surface waves propagating radially outward away from the center point through the plurality of radiating spokes.

12. The apparatus of claim 1 further comprising:

a radio frequency module that sends a number of radio frequency signals to the number of surface wave feeds.

13. An antenna system comprising:

a dielectric substrate;

a plurality of radiating spokes arranged radially with respect to a center point of the dielectric substrate, wherein each of the plurality of radiating spokes forms a surface wave channel configured to constrain a path of a surface wave and wherein each of the plurality of radiating spokes comprises:

a plurality of impedance elements located on a surface of the dielectric substrate; and a plurality of tunable elements located on the surface of the dielectric substrate and electrically connected to the plurality of impedance elements;

a voltage controller that controls voltages applied to the plurality of tunable elements of each radiating spoke to control a theta steering angle of a main lobe of a radiation sub-pattern generated by each radiating spoke; and a number of surface wave feeds, wherein each of the number of surface wave feeds couples at least one corresponding radiating spoke in the plurality of radiating spokes to a transmission line that carries a radio frequency signal.

14. A method for electronically steering a radiation pattern of an antenna, the method comprising:

propagating surface waves along a plurality of surface wave channels formed by a plurality of radiating spokes to generate a number of radiation sub-patterns, wherein the plurality of radiating spokes is arranged radially with respect to a center point of a dielectric substrate and coupled to a number of surface wave feeds, and wherein each of the plurality of radiating spokes comprises:

a plurality of tunable elements located on a surface of the dielectric substrate; and a plurality of impedance elements located on the surface of the dielectric substrate and electrically connected to the plurality of impedance elements; and steering, electronically, a main lobe of the radiation pattern of the antenna in two dimensions.

15. The method of claim 14, wherein steering, electronically, the main lobe of the radiation pattern of the antenna in the two dimensions comprises:

controlling voltages applied to each radiating spoke in the plurality of radiating spokes to electronically steer a main lobe of a corresponding radiation sub-pattern produced by each radiating spoke in the plurality of radiating spokes in a theta direction.

16. The method of claim 15, wherein controlling the voltages applied to each radiating spoke in the plurality of radiating spokes comprises:

controlling the voltages applied to each of the plurality of radiating spokes to electronically steer the number of radiation sub-patterns, wherein the number of radiation sub-patterns overlap such that the main lobe of the radiation pattern of the antenna is steered in a particular phi direction.

17. The method of claim 14 further comprising:

generating linearly polarized radiation using the plurality of radiating spokes.

18. The method of claim 14 further comprising:

generating circularly polarized radiation using the plurality of radiating spokes.

19. The method of claim 14 further comprising:

controlling voltages applied to the plurality of radiating spokes such that the plurality of radiating spokes produce an overall radiation pattern that is one of circularly polarized and linearly polarized.

* * * * *